US006931747B2

(12) United States Patent
Rego

(10) Patent No.: US 6,931,747 B2
(45) Date of Patent: Aug. 23, 2005

(54) TAILORING GUIDE SYSTEM

(76) Inventor: Fernando Rego, 130 King Street West, Box 16, Toronto, Ontario (CA), M5X 1A9

( * ) Notice: Subject to any disclaimer, the term of this patent is extended or adjusted under 35 U.S.C. 154(b) by 0 days.

(21) Appl. No.: 10/725,024

(22) Filed: Dec. 2, 2003

(65) Prior Publication Data

US 2004/0107593 A1 Jun. 10, 2004

Related U.S. Application Data

(60) Provisional application No. 60/489,901, filed on Jul. 25, 2003.

(51) Int. Cl.[7] ..... G01B 1/00; G01B 5/00; A41H 1/04

(52) U.S. Cl. ..... 33/512; 33/2 R; 33/17 R; 177/245

(58) Field of Search ..... 33/2 R, 7, 8, 17 R, 33/511, 512, 515; 177/2, 4, 5, 245

(56) References Cited

U.S. PATENT DOCUMENTS

| | | | | | |
|---|---|---|---|---|---|
| 465,252 | A | * | 12/1891 | Ericson | 33/7 |
| 972,705 | A | * | 10/1910 | Moritz | 33/8 |
| 1,863,236 | A | * | 6/1932 | Brienza | 33/7 |
| 2,052,099 | A | * | 8/1936 | Lytton | 33/8 |
| 2,053,810 | A | * | 9/1936 | Bisel | 33/2 R |
| 2,063,922 | A | * | 12/1936 | Greenberg | 33/2 R |
| 2,795,852 | A | | 6/1957 | Ermilio | |
| 2,818,648 | A | * | 1/1958 | Jochheim | 33/8 |
| 4,473,949 | A | * | 10/1984 | Schechtman | 33/512 |
| 4,586,150 | A | | 4/1986 | Ahlin et al. | |
| 4,924,598 | A | * | 5/1990 | Gruhler | 33/832 |
| 5,088,504 | A | * | 2/1992 | Benesh et al. | 33/515 |
| 5,131,166 | A | * | 7/1992 | Weber | 33/832 |
| 5,142,793 | A | * | 9/1992 | Crane | 33/763 |
| 5,373,645 | A | * | 12/1994 | Bezinge et al. | 33/703 |
| 5,406,715 | A | * | 4/1995 | Koizumi et al. | 33/512 |
| 6,327,791 | B1 | * | 12/2001 | Norcross et al. | 33/706 |
| 6,415,199 | B1 | * | 7/2002 | Liebermann | 33/512 |
| 6,646,209 | B2 | * | 11/2003 | Montagnino et al. | 33/512 |
| 2003/0076318 | A1 | * | 4/2003 | Shaw-Weeks | 345/419 |
| 2004/0111911 | A1 | * | 6/2004 | Scannell | 33/706 |

FOREIGN PATENT DOCUMENTS

| | | |
|---|---|---|
| DE | 28 23 645 A | 12/1979 |
| FR | 1 149 861 A | 1/1958 |
| GB | 947 036 A | 1/1964 |
| GB | 1 463 804 A | 2/1977 |

OTHER PUBLICATIONS

Jan. 1829, Lemont, L.P.*

* cited by examiner

*Primary Examiner*—G. Bradley Bennett

(57) ABSTRACT

A tailoring guide is used for taking body measurements for garment fitting. The guide comprises an upright portion of a height at least as great as that of an individual of average height and a spread assembly which is adjustable in height relative to the upright portion. The upright portion includes height measurements to determine different heights to which the spread assembly is adjusted. The spread assembly itself comprises a pair of arms one to each side of the upright portion. The arms of the assembly are adjustable inwardly and outwardly to different spread positions relative to the upright portion and the spread assembly is provided with a measuring guide to determine positioning of the arms in the different spread positions.

17 Claims, 22 Drawing Sheets

32
71
7
31
3
73
35
39
43
57
53

105
104
104

127
131
139
137
139
127
129
137
135
125
141
141
161
142
142
123
111
109

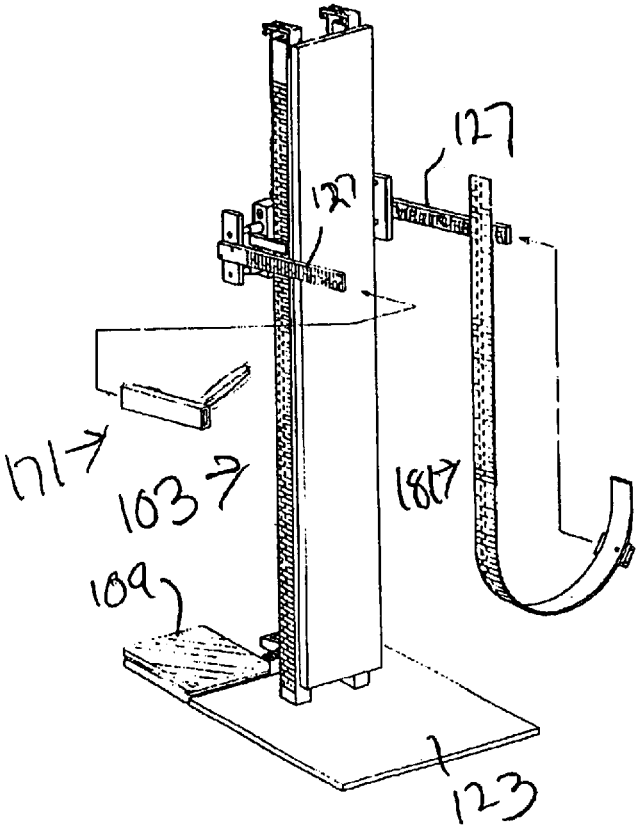
FIG 23
FIG 24
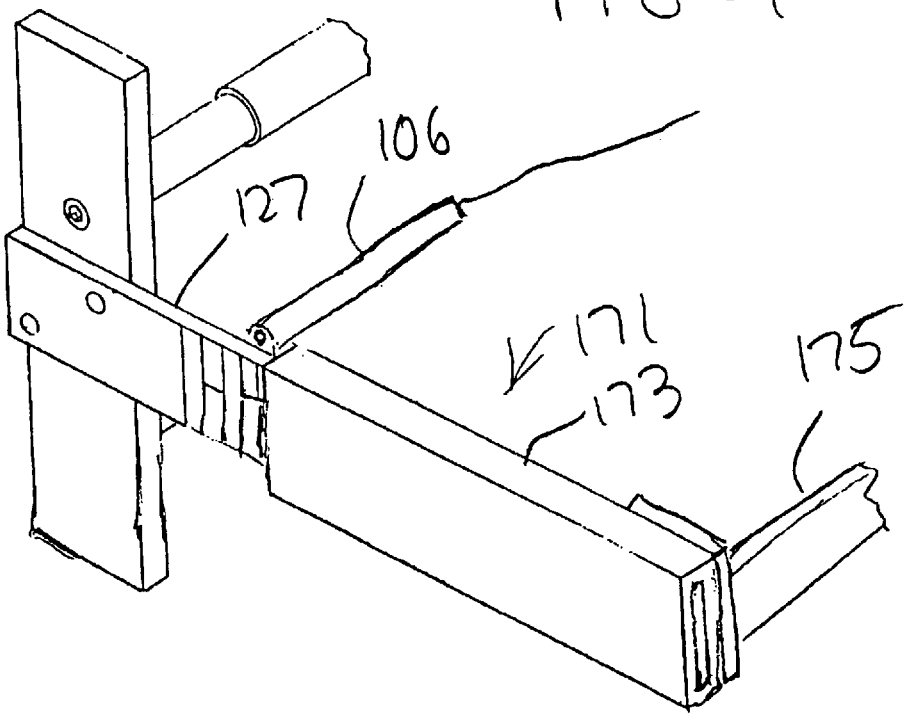

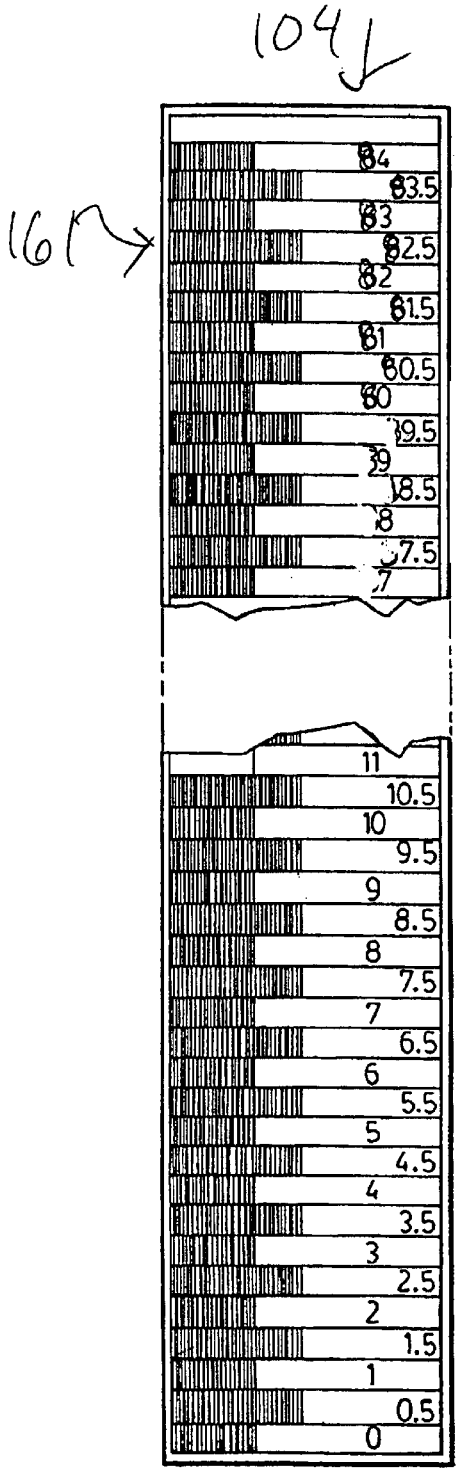
FIG25
FIG26
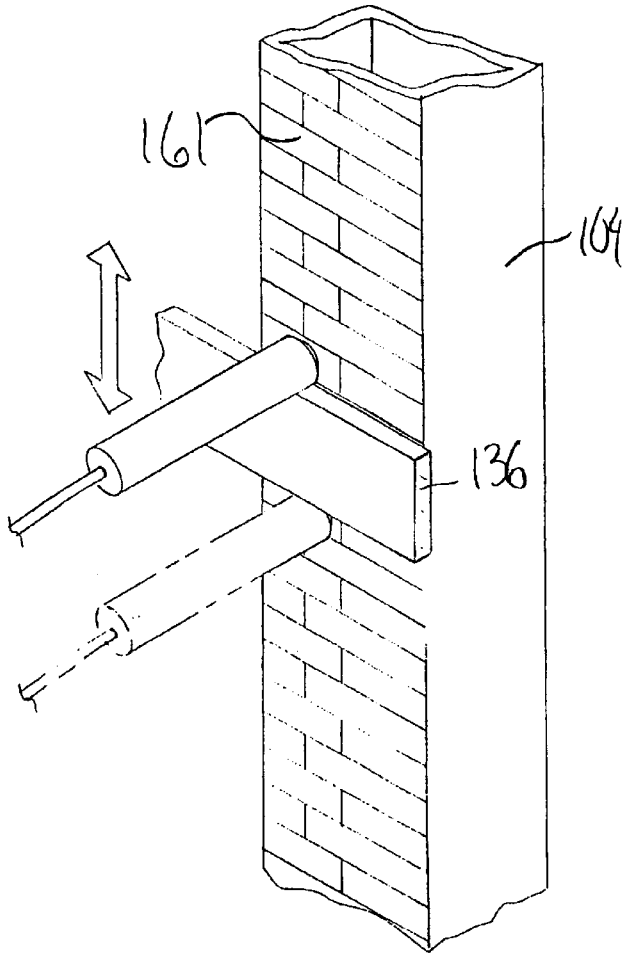

TAILORING GUIDE SYSTEM

This application claims the benefit of Provisional application Ser. No. 60/489,901, filed Jul. 25, 2003.

FIELD OF THE INVENTION

The present invention relates to a tailoring guide system used for taking different body measurements needed for a custom fitted garment.

BACKGROUND OF THE INVENTION

In the making of a custom fitted garment such as custom fitted jackets, pants and full suits or even for the rental of a custom fitted garment the taking of accurate measurements at different accurately measured locations on an individual is critical for proper fitting of the garment. In years gone by, experienced trained tailors have been able to perform these measuring functions with a relatively high degree of accuracy. However, these old time tailors are now becoming a thing of the past and younger people training in this field typically do not have the same high skills of the older tailors. Furthermore, even the older tailors who are still working in the field encounter difficulties when working with certain individuals who have body proportions that make the taking of hand measurements very difficult. In addition, even a truly skilled tailor can be inaccurate in his or her hand measuring techniques.

SUMMARY OF THE PRESENT INVENTION

The present invention provides a tailoring guide system which is able to assist an individual in taking body measurements of another individual. The system of the present invention is one which allows a person who is taking the measurements whether well skilled or not to take extremely accurate measurements.

The system of the present invention includes an upright main body portion having height measurements on the upright body portion and an adjustable spread assembly height adjustably supported by or adjacent to the upright body portion.

Through the use of the upright body portion and the adjustable spread assembly when set to different height settings relative to the upright body portion and when set to different spread positions a person taking measurements of another individual is able to accurately measure for things such as overall body height, shoulder height and shoulder levelness, chest size, waist size and seat size. Furthermore, through the use of very simple additional tools the system is able to assist in the taking of further measurements such as outsleeve arm length, insleeve arm length, inseam leg length and outseam leg length.

As a further embodiment of the present invention the tailoring guide system can also incorporate features to allow the accurate taking of body weight of an individual being measured with the system.

According to an aspect of the invention, a tailoring system is provided using an upright body portion including moveable parts for taking different body measurements of a person at the upright body portion. The tailoring system includes electronically readable measuring means on the upright body portion and an electronic reader which reads positioning of the moveable parts relative to the electronically readable measurement means to provide the different body measurements.

In a preferred embodiment of the above aspect of the invention, the electronically readable measurement means comprises a plurality of bar coded regions on the upright body portion and the electronic reader comprises a bar code reader which reads and transfers the different body measurements to a data storage member.

BRIEF DESCRIPTION OF THE DRAWINGS

The above as well as other advantages and features of the present invention will be described in greater detail according to the preferred embodiments of the present invention in which;

FIG. 23 is a view similar to FIG. 17 but showing an alternate positioning for one of the tools on the upright body portion;

FIG. 24 is a view similar to FIG. 21 showing the alternate positioning of the tool of FIG. 23;

FIG. 25 is a front view of a length of bar code provided along a side edge of the upright body portion of FIG. 17;

FIG. 26 shows a bar code reader reading measurement from the length of bar code shown in FIG. 25.

DETAILED DESCRIPTION ACCORDING TO THE PREFERRED EMBODIMENTS OF THE PRESENT INVENTION IN WHICH

Figure 1:
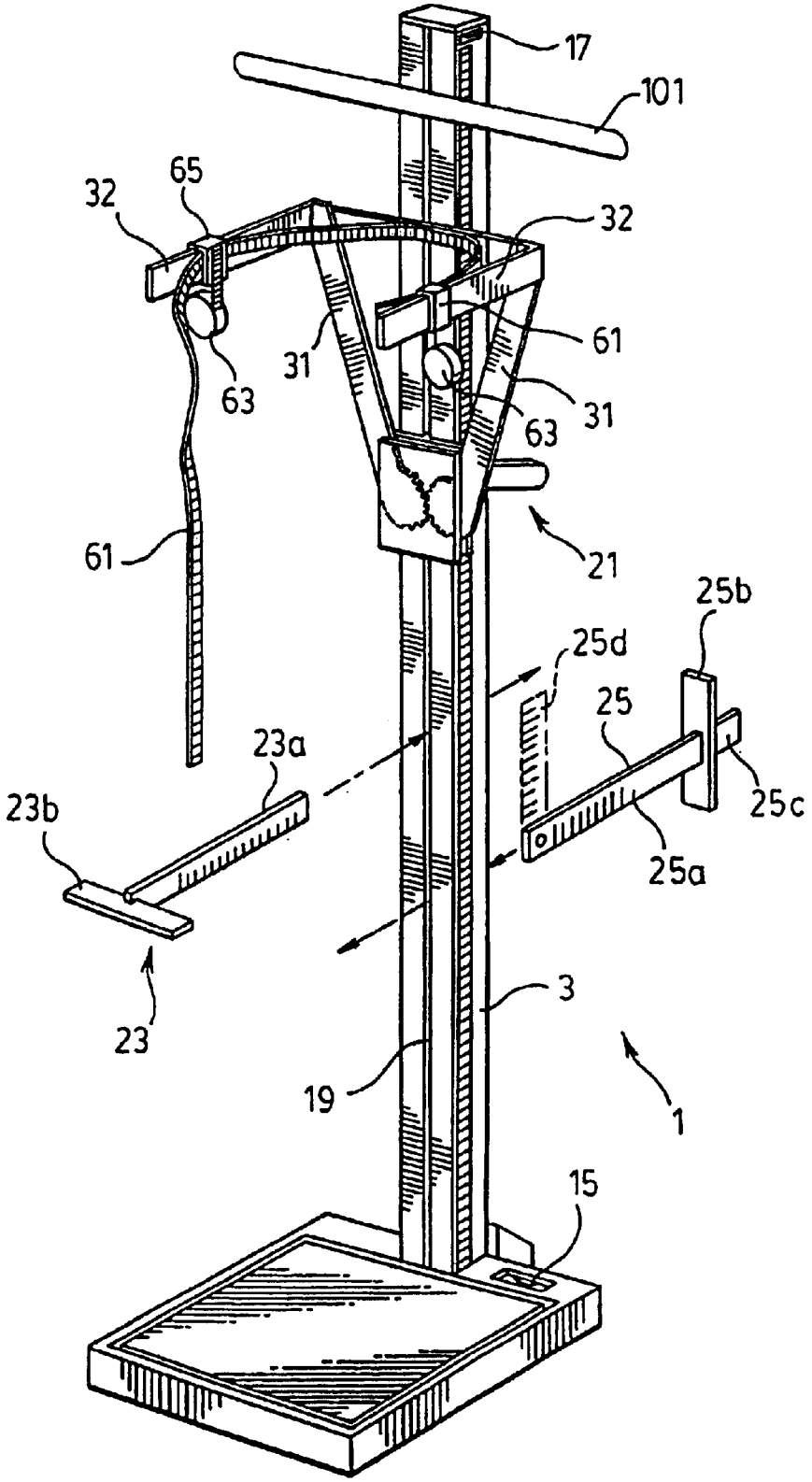
FIG. 1 is a front perspective of the tailoring guide system according to a preferred embodiment of the present invention.
Figure 2:
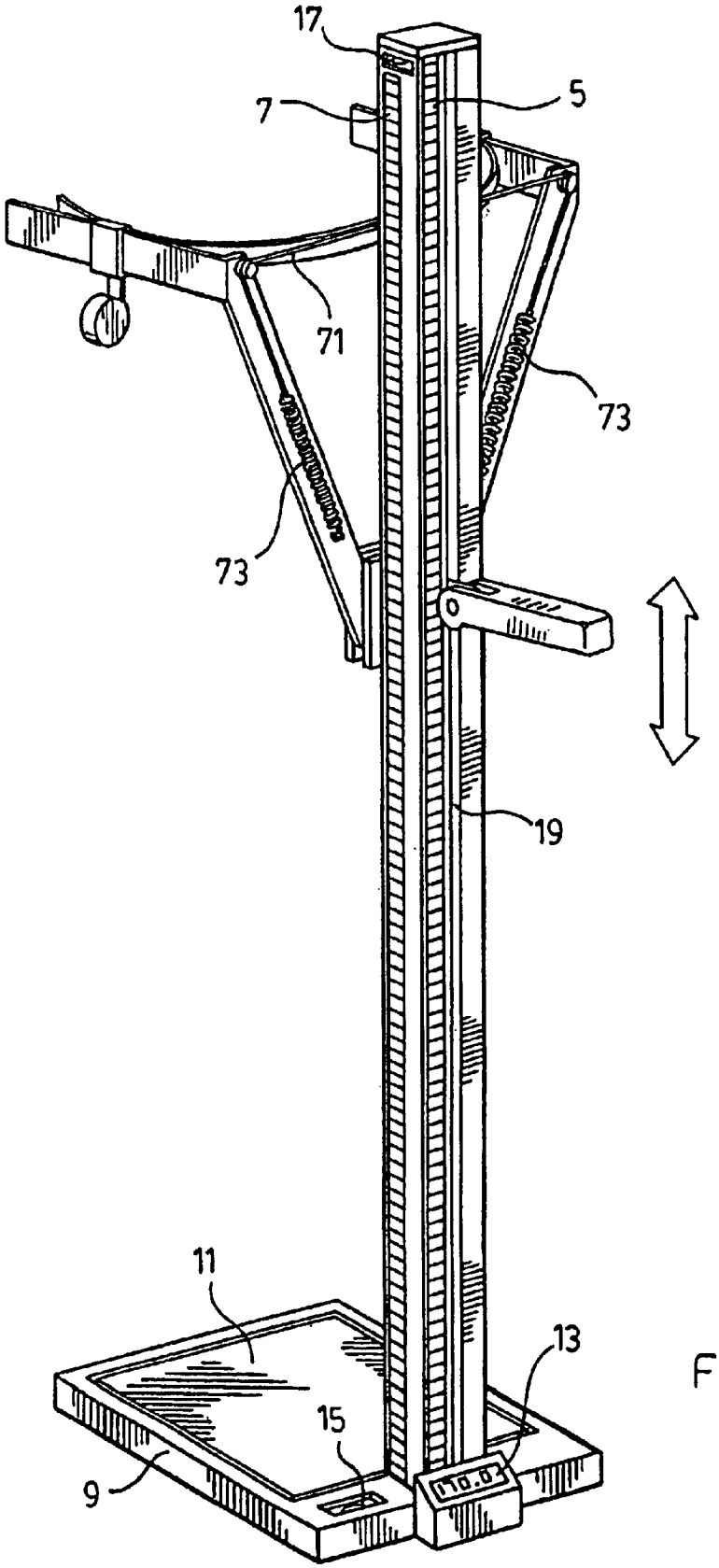
FIG. 2 is a rear perspective view of the system of FIG. 1.

FIGS. 1 and 2 show a tailoring guide system generally indicated at 1. This system is built around an upright body portion 3. Supported on body portion 3 is an adjustable spread assembly generally indicated at 21.

Figure 3:
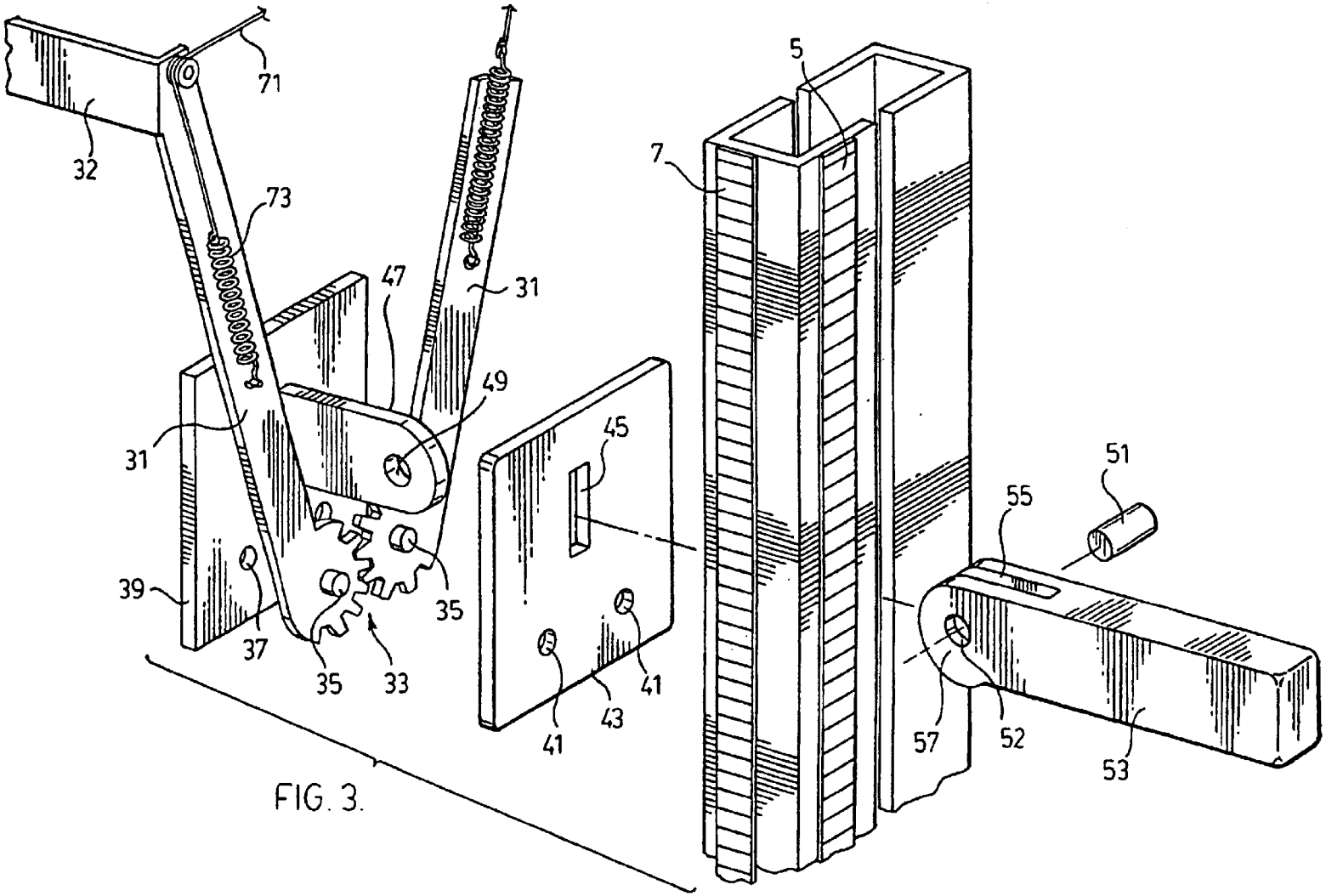
FIG. 3 is an exploded perspective view for the mounting components of the spread assembly from the system of FIG. 1.

Body portion 3 as seen in FIG. 1 and as better shown in FIG. 3 includes first and second height measuring scales or tapes 5 and 7. One of these scales may provide measurements in feet and inches while the other scale may be a metric scale. Both of the scales are used to provide different height measurements relative to a support platform or base 9 for the upright body portion. Also provided in this base is a weight scale 11 having a readout 13. In the preferred embodiment as shown the readout is located to the rear of the base so that an individual being weighed on the scale will not see his or her own weight which can cause concern to the individual being weighed. However, a person taking measurements for that individual will easily be able to see the weight of the individual at readout 13.

Body portion 3 is at least as tall as the height of an average individual and is preferably taller than an average height. It may be as tall as 7 feet or more and is used to show the height of an individual standing in front of the upright body portion.

It is very important that body portion 3 be in a completely vertical position. In order to assure this the upright body portion includes its own level. In the preferred embodiment shown this level is in the form of a bubble level 17 at the upper end of body portion 3. Additionally provided is a further level 15 in the base support 9.

Since the upright body portion is perpendicular to the base then the upright body portion will be vertical when the base is level. Through the provision of both levels 15 and 17 a person using the system to take a reading off of either the base or the upright body portion to determine accuracy of the upright positioning of body portion 3.

Figure 9:
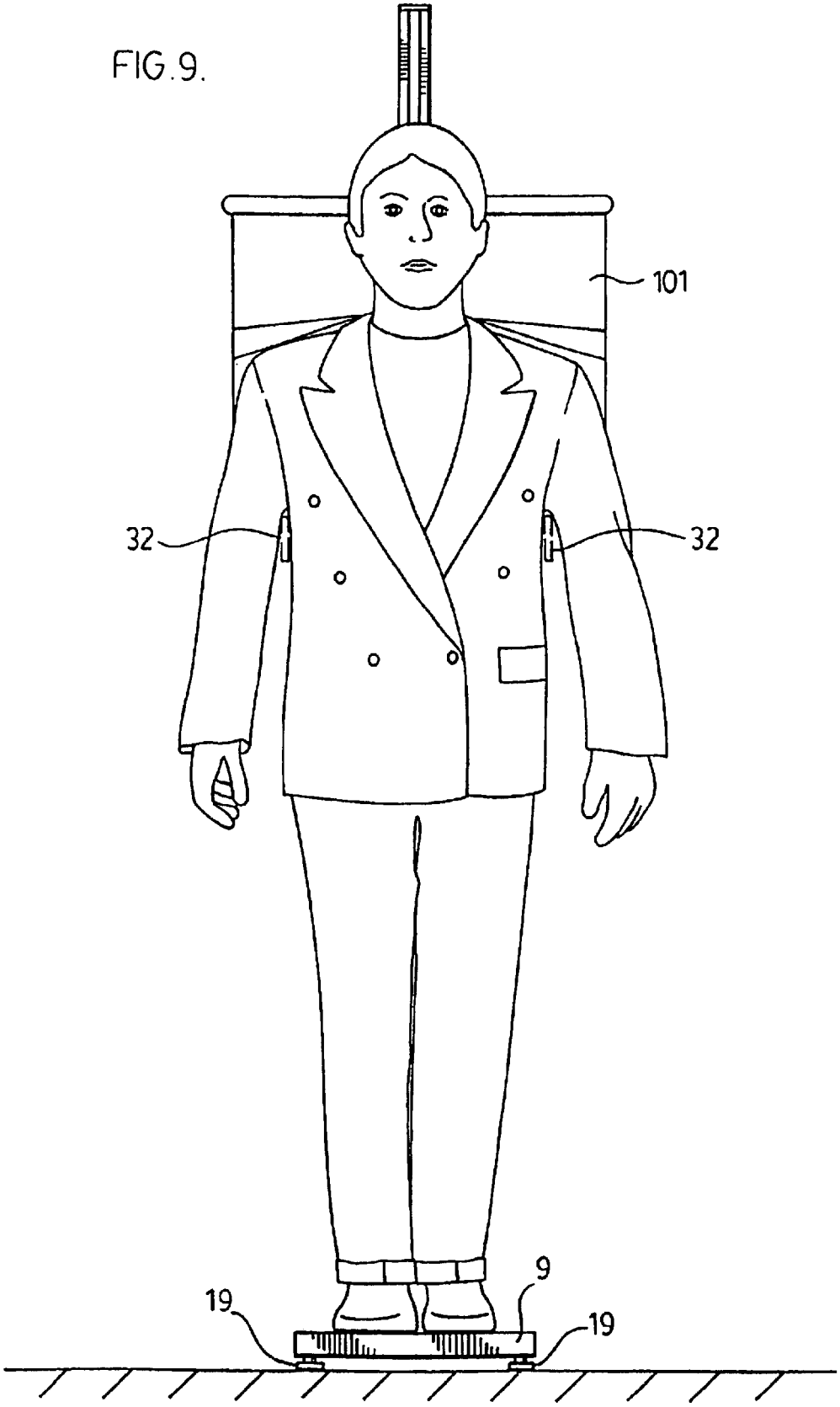

FIG. 9 shows that the base 9 includes adjustable feet 19 which are used to adjust the base to a level setting for adjusting upright positioning of body portion 3 in the event that the support surface for the base is not level.

FIGS. 1, 2 and 3 show another preferred feature of the invention wherein body portion 3 includes a center slot 19 penetrating completely through the body portion. In addition, the upright body portion preferably has a hollow construction as shown in FIG. 3 which makes the body portion both light in weight and extremely versatile for receiving different types of adjustable assemblies such as the spread assembly 21 or different hand operated measuring tools.

The tools referred to above include tools such as indent measuring tool 23 and inseam and pant rise measuring tool 25. These tools are specifically designed to cooperate with body portion 3 and more specifically with the center slot 19 of body portion 3. The use of these tools will be described later in greater detail.

FIG. 1 shows that indent tool 23 preferably has a T-shaped construction including a main body part 23*a* and a head part 23*b*. The main body part 23*a* is provided with a measuring scale the purpose of which is better shown in FIG. 15 of the drawings again to be described later in detail. FIG. 1 shows that while part 23*a* fits through slot 19 in the body portion 3 the head 23*b* of the indent tool prevents the tool from being inadvertently completely pulled through the slot 19 in the upright body portion.

Inseam measuring tool 25 has a sword like construction. It includes a main forward arm 25*a*. This arm fits through the slot 19 in body portion 3. A stop 25*b* and a handle 25*c* are provided at the backend of the tool. The stop 25*b* prevents the tool from passing completely through slot 19 and assures that the forward arm 25*a* is perpendicular to the upright body portion when the stop is placed up against the back of body portion 3. The handle 25*c* provides a grip for manipulating the tool.

Also provided on tool 25 is a foldable arm part 25*d*. This foldable arm part includes its own measuring scale. The foldable arm part folds from a non use position in which it lies along the length of the arm 25*a* to a use position extending perpendicular to arm 25*a*. The purpose of the foldable arm part 25*d* is to provide a pant rise measuring tool when it is in the upwardly extending dotted line position of FIG. 1. Again this will be better described with respect to FIG. 15 of the drawings.

A particular method of mounting the adjustable spread assembly 21 and means for adjusting position of that assembly is shown in FIGS. 3 through 6 of the drawings. It is however to be appreciated that numerous other mounting and adjustment arrangements can be provided for assembly 21 such as the arrangement shown in FIG. 7 of the drawings.

Returning to the FIGS. 3 through 6 embodiment of the adjustable spread assembly, this assembly comprises a pair of arms 31 having a gear connection 33 which connects arms 31 to one another indicated at 33. Each of the arms is mounted by a pivot pin 35 to a pair of plates 39 and 43. The pivot pins 35 of these two arms fit into opening 37 on plate 39 and opening 41 on plate 43.

Plate 43 includes an elongated opening 45 with a tongue 47 of plate 39 fitting through that opening. Plate 45 rides along the flat front surface of body portion 3 while the tongue 47 of plate 39 penetrates through the center slot 19 of the upright body portion. The tongue then enters a slot 55 of a lever arm 53. A pivot pin 51 fits through the aligned openings 52 of the lever arm 53 and opening 49 of tongue 47. This then provides an assembly of the lever arm with the two plates which in turn hold arms 31 in position.

Figure 4:
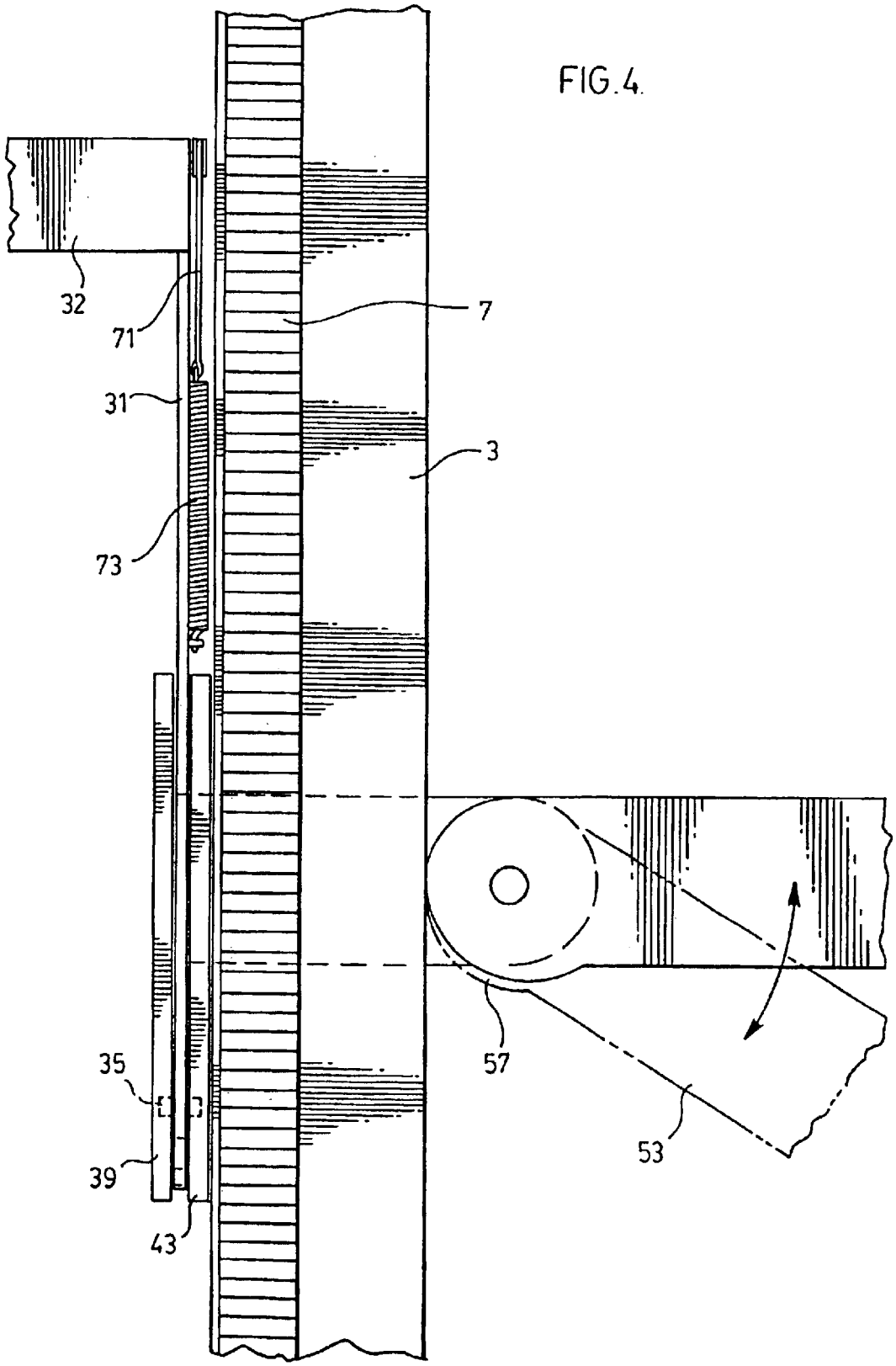
FIG. 4 is an enlarged side view of the spread assembly mounting region of the system of FIG. 1.

Lever arm 53 as best shown in FIG. 4 of the drawings has a cam shaped head 57. By adjusting the arm between a horizontal and a vertical position one is able to either tighten i.e., clamp the assembly relative to the upright body portion or release the assembly to a point which allows the assembly to be slid up and down on the upright body portion.

As well shown in FIG. 1 of the drawings the arms 31 i.e., the inner arm parts of the assembly are provided with outer arm parts comprising forward extensions 32. Measuring devices in the form of a hanging tape 61 and retractable tapes 63 are provided on the forward extension 32 of arms 31. The retractable tapes 63 are mounted by slide brackets 65 to the extensions 32. Tape 61 is secured at one end to one of these slide brackets and fits through the other of the two slide brackets. Accordingly, as slide brackets move inwardly and outwardly on the forward extensions 32 and the hanging tape 61 moves with them.

Figure 5:
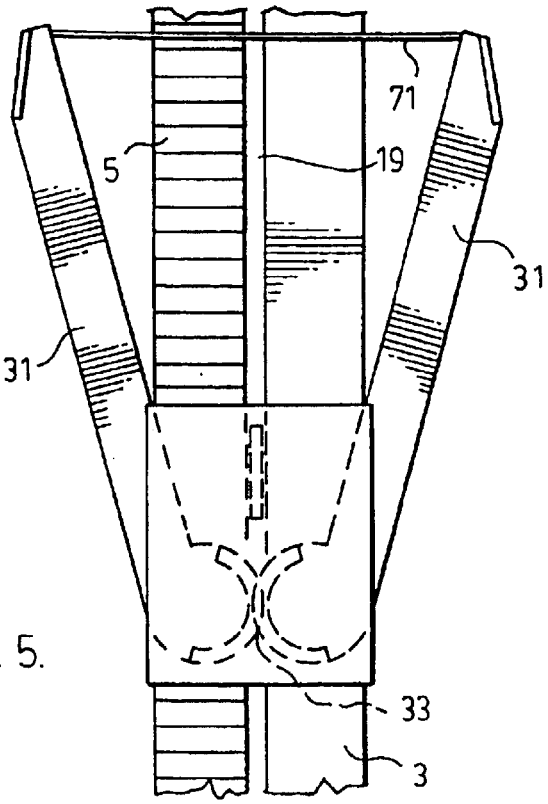
FIGS. 5 and 6 are rear views showing different spread positions of the spread assembly from the system of FIG. 1.
Figure 6:
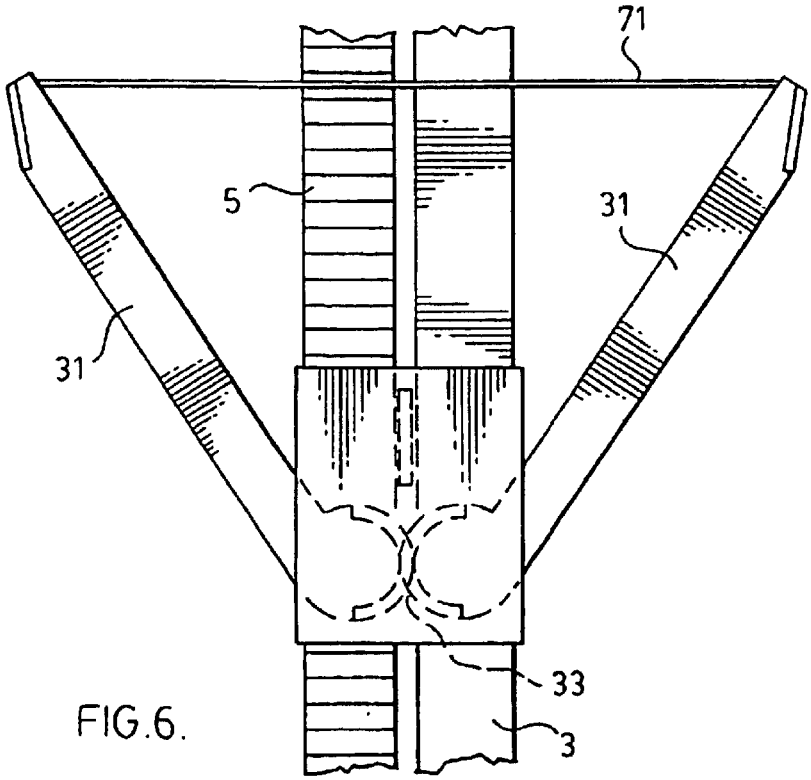
Figure 7:
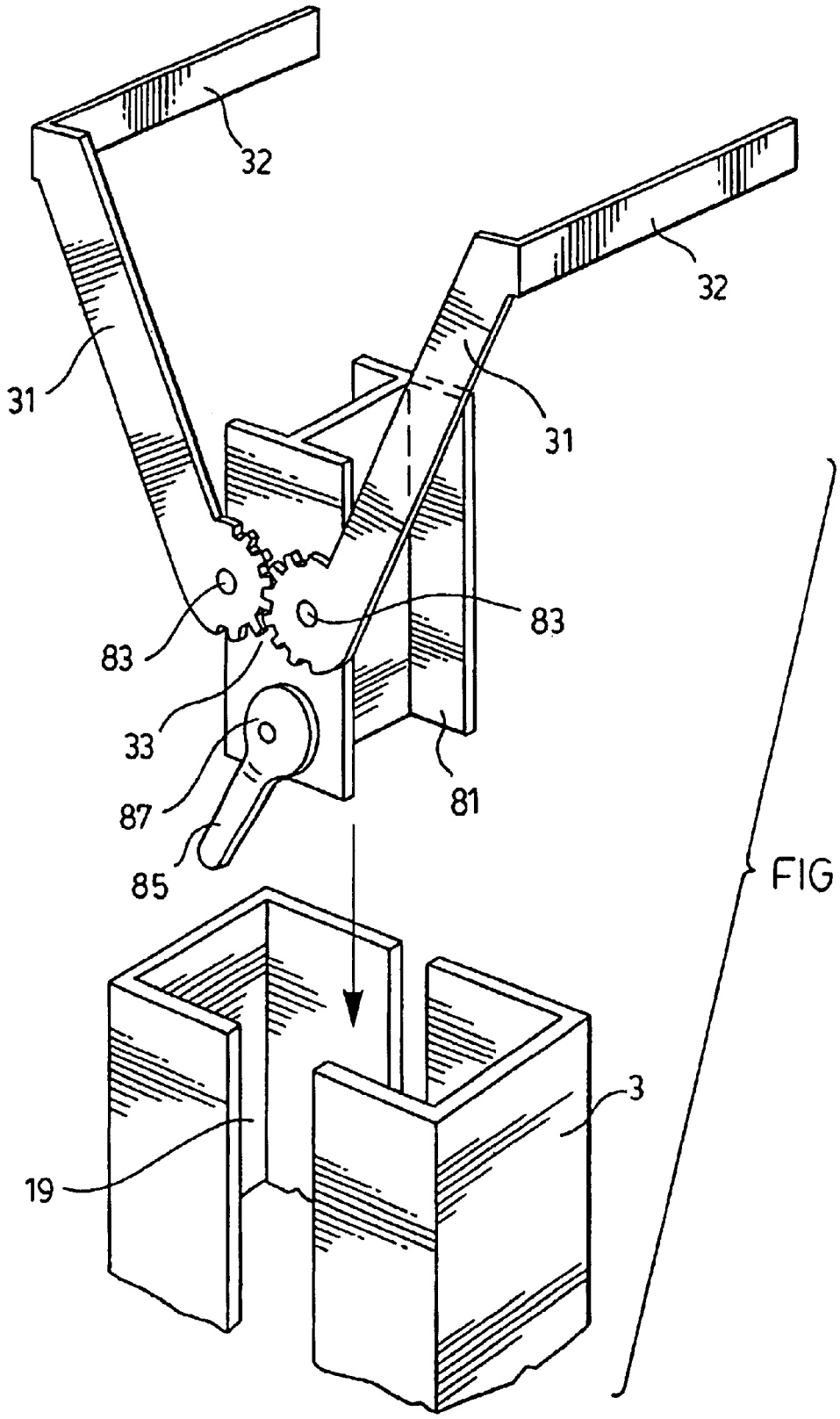
FIG. 7 is an exploded perspective view of an alternate spread assembly for mounting to the upright body portion of the system according to another preferred embodiment of the present invention.

As is well shown in FIGS. 5 and 6 of the drawings the arms 31 with their forward extensions 32 move to different spread positions. As a result of the gear connection 33 between the arms the movement of one arm automatically causes equivalent movement of the other arm.

When the arms are in the FIG. 5 position they are essentially stored out of the way rather than hanging out to a position where, when they are not in use, they might present an obstacle in an area where the device is to be used. When the device is to be used the arms are then lowered i.e., spread from one another to different spread settings for taking different body measurements as to be described later in detail.

As can be readily seen in FIG. 4 of the drawings the height of the mount for the spread assembly regardless of the position to which it is set on body portion 3 is easily read off of either one of two measuring scales 5 and 7 on the body portion. In addition, and as well seen in comparing FIGS. 2 through 4 of the drawings an additional measuring device in the form of a flexible line member 71 is provided. This line member 71 is attached by springs 73 to the arms to keep the flexible line taut at different arm spread positions. This member then provides a more easily readable measurement for the height setting of the upper ends of the arms where the forward extensions 32 are provided. Again the reason for this will be described with respect to the actual measurement taking figures of the drawings. However, before turning to those drawings reference is now had to FIG. 7 of the drawings. This particular figure again shows the arms 31 provided with forward extensions 32 and having a geared connection 33 between the arms. However, in this particular case the arms are mounted to an I-shaped bracket 81 having pivotal connections 83 with the arms. Also pivotally attached to bracket 81 is a clamping lever 85. This clamping lever includes a cam shaped head 87.

In this particular example, bracket 81 fits interiorly of the hollow construction of body portion 3. The arms 31 locate to the rear of the upright body portion with the arm extension projecting forwardly of the body portion. The head 87 of lever arm 85 locates within slot 19 of body portion 3. By pivoting the lever 85 a person using the device can then either lock the assembly on body portion 3 or release it for adjustment relative to the body portion. This would be one operation and the movement of the arms to various different settings would be a totally separate operation.

The arm assembly can be made relatively light in weight and simple balancing devices can also be provided so that when the lock up pressure is released up or down movement of the assembly would require nothing more than a relatively minor finger push pressure.

As is to be appreciated the above examples of mounting the spread assembly to body portion 3 are only two of a host of different ways of putting the arm assembly and the upright body portion together with one another. Furthermore, other ways of adjusting the arms to different spread positions can also be used. The critical feature is that the spread assembly is height adjustable on the upright body portion and that the arms do move to different spread positions. The reason for this is now to be described in detail with respect to FIGS. 8 through 14 of the drawings.

Figure 8:
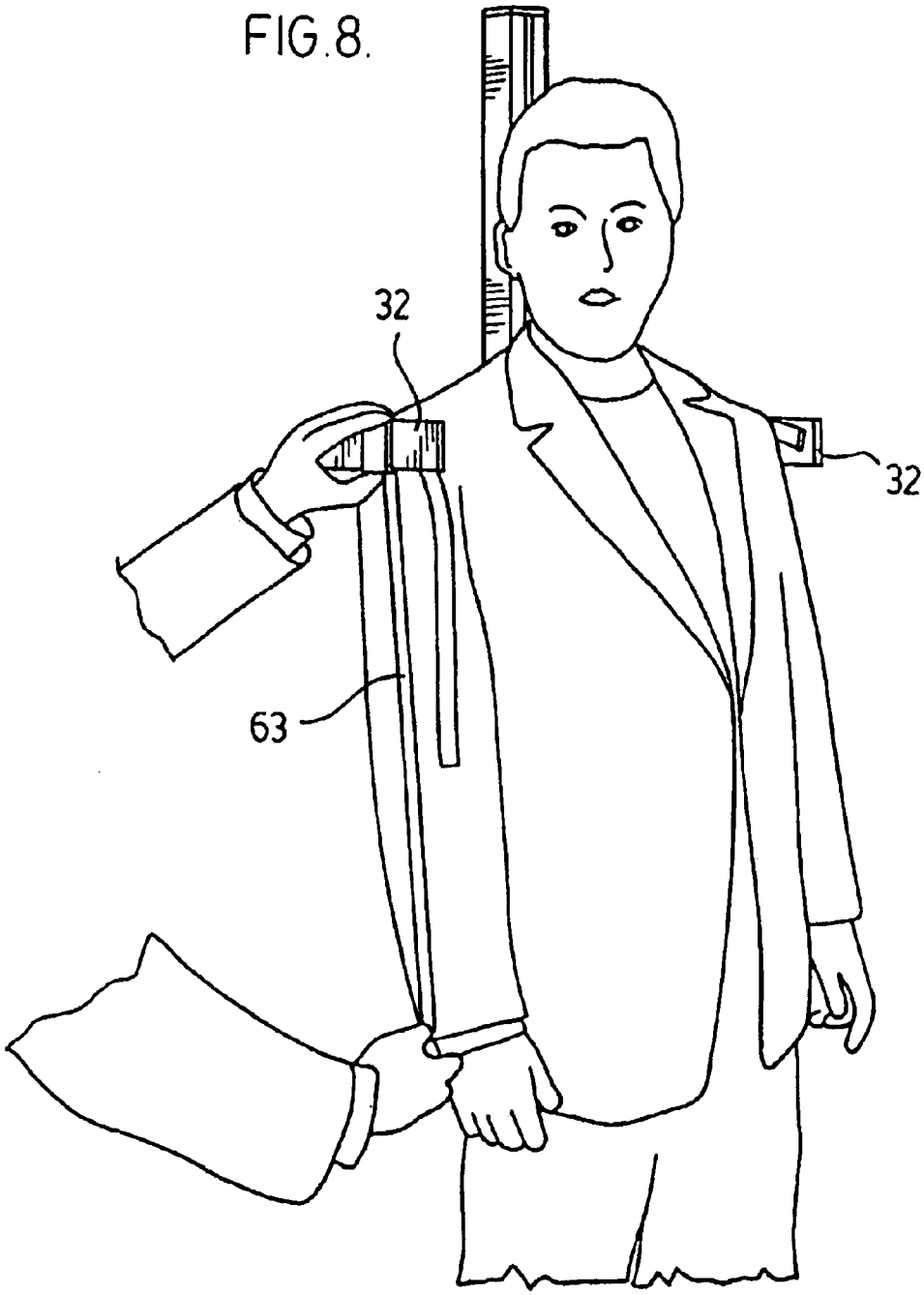
FIGS. 8 through 15 are views showing the taking of different preferred body measurements using the system of FIG. 1.

FIG. 8 of the drawings shows how the device is used to take an outsleeve measurement. In order to take this measurement the spread assembly 21 is height adjusted and then the forward projections 32 of the assembly are spread adjusted such that they locate to the outside of the shoulders of the individual being measured as shown in FIG. 8. This is done when the individual is wearing a jacket as shown. At this point, the retractable tape 63 which is slide mounted by bracket 65 on the arm projection is aligned with the shoulder positioning is used to take the length measurement along the outside of the arm.

The above measurement is then recorded and this could be done in a number of different ways. For instance, it can be done in the conventional manner in which the measurement is simply written down. However, for this measurement as well as all of the other measurements to be described later in detail the device itself can include sensors which automatically pick up the measurement and store them and/or pick them up and feed them to a central database or to other locations such as a suit manufacturers. More will be described about this feature later in detail.

FIG. 9 shows the device set-up to take an insleeve measurement. More particularly, with the person being measured keeping his or her jacket on the spread assembly and in particular the forward projections 32 of the spread assembly are adjusted to fit directly beneath the underarms of the individual. Once again, the retractable tape 63 at each of the arm projections 32 is used to take insleeve measurements as shown in FIG. 9 on each of the arms of the individual.

Figure 10:
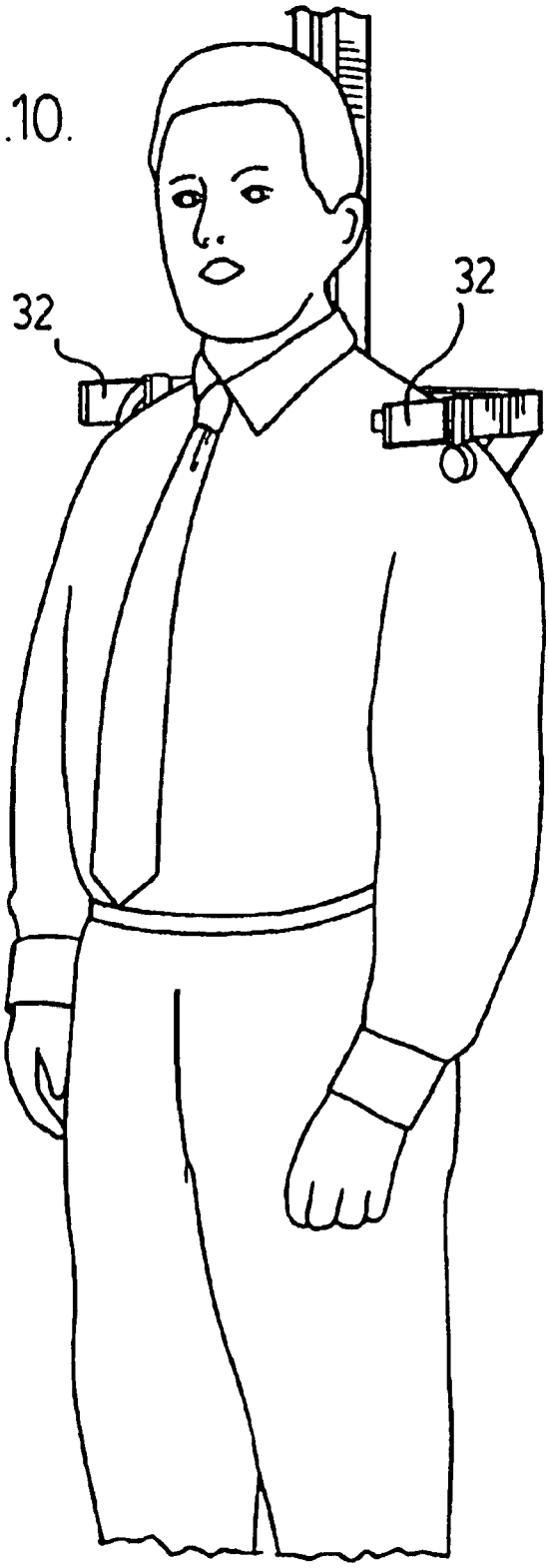

The individual then removes his or her jacket for a shoulder height and shoulder levelness measurement as shown in FIG. 10 of the drawings. For this measurement the spread assembly is height adjusted on body portion 3 such that the arm projections 32 seat atop the shoulders as shown. The height of the projections relative to the base of the unit on which the person is standing is then measured off of either one of scales on the upright body portion.

In some cases, one shoulder may not be level with the other shoulder. Under these circumstances the projection 32 positioned above the higher or taller of the two shoulders is placed on that shoulder and a separate measurement is then taken to determine the gap between the other arm projection 32 and the lower of the two shoulders. This will then provide an accurate measurement as to which shoulder is higher and by how much.

Figure 11:
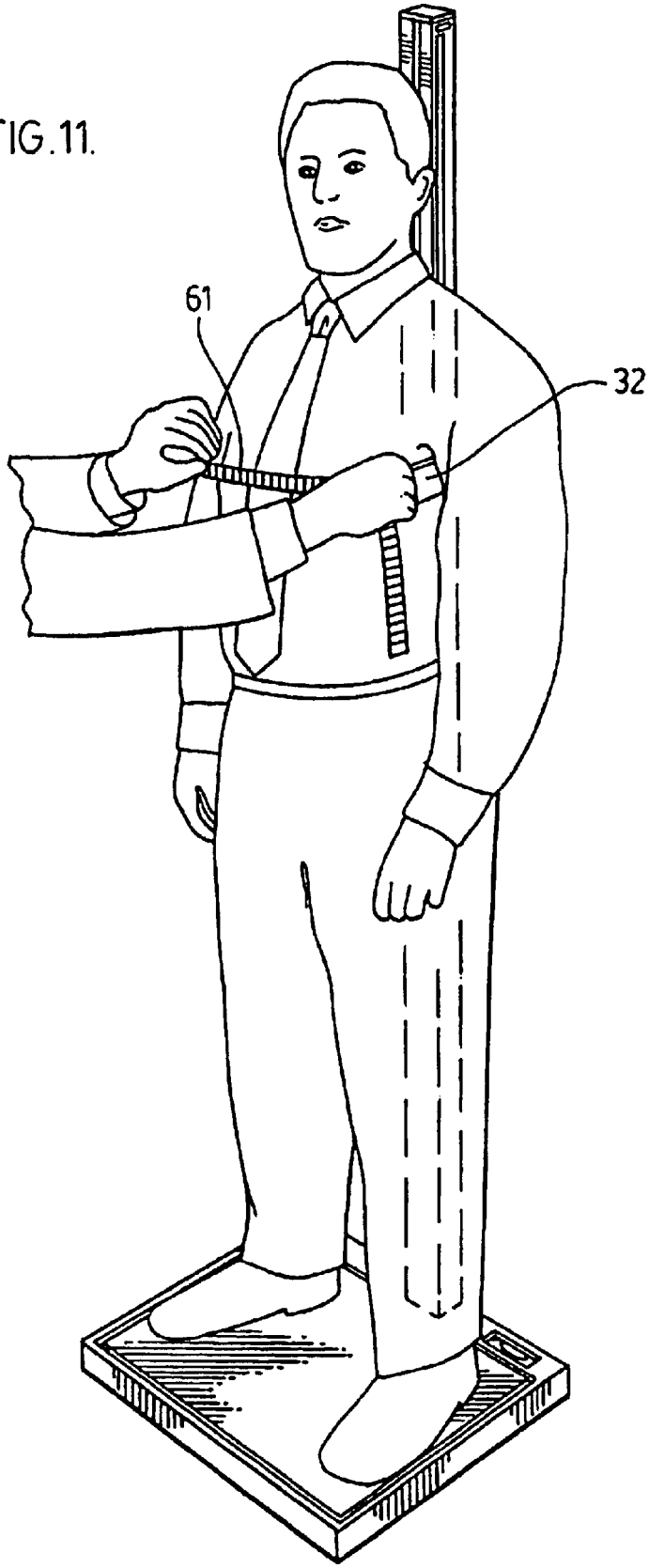

Although the sequence of measurements is not important one of the next measurements to be taken is the chest measurement as shown in FIG. 11 of the drawings. In order to take this measurement the projections 32 of the arms 31 are set to the proper height and the proper spread position such that they locate in the armpit region of the individual with the individual not wearing a jacket. The person taking the measurement then uses the hanging or free tape 61 for this measurement. Here it should be noted that the projections 32 provide a guide to properly position the tape which slides via the slide mounts 65 to a position where the tape can be tightly wrapped around the upper torso of the individual.

For the chest measurement as described above and like all of the other measurements taken the projections of the arms provide a tremendous benefit in that they eliminate the need for the individual taking the measurements to have to reach completely around the individual being measured. When using conventional measuring techniques without the use of the mechanical device of the present invention this can be an almost impossible task if the person being measured is of substantial size while the person taking the measurement is much smaller and does not have sufficient arm length to reach around the individual. Furthermore, without the device of the present invention it can be very difficult to be sure that the tape is wrapped at a level position around the individual since the person taking the measurements cannot see where the tape is located on the back of the individual being measured. This is not a problem in accordance with the present invention since the arm projections ensure the levelness of the tape at the individuals back while the person taking the measurement can see that the tape is level across the front of the individual.

Figure 12:
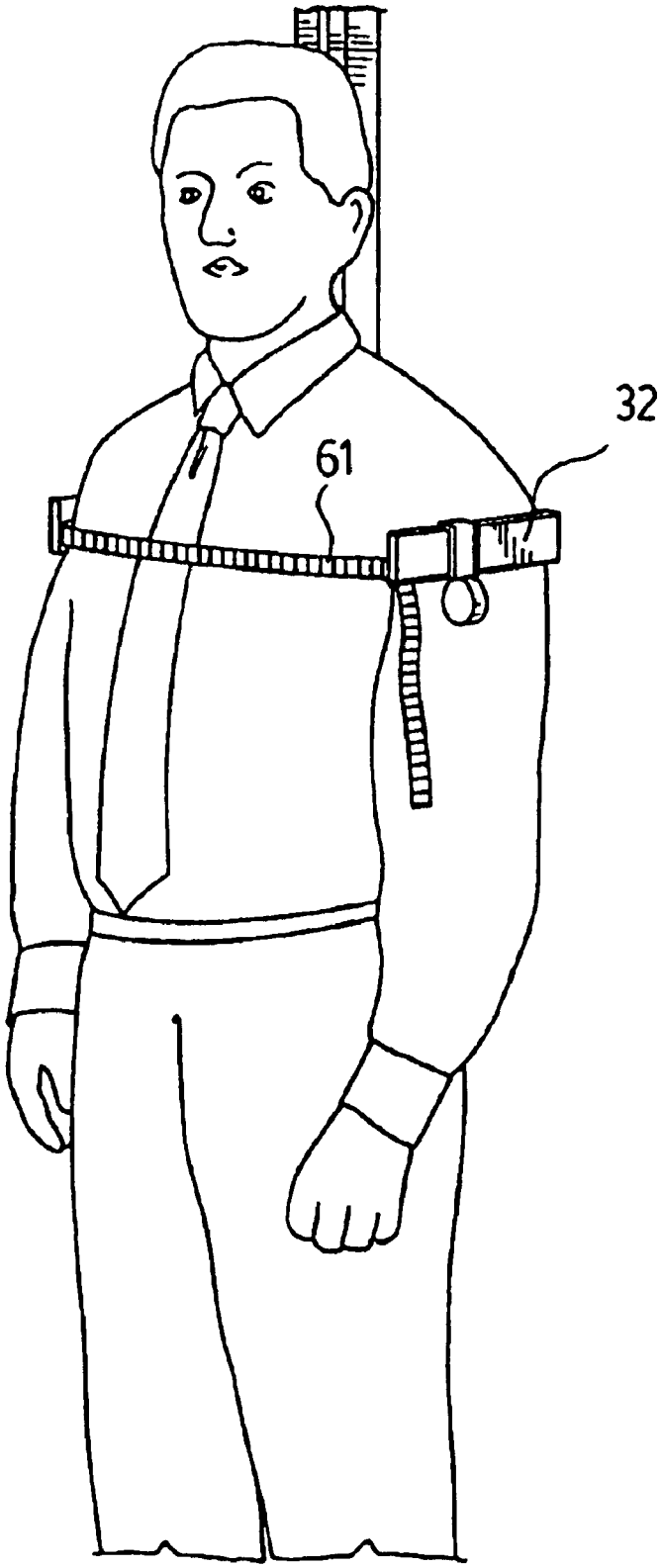

Another measurement that can be taken when the person is not wearing the jacket is the overarm measurement as shown in FIG. 12 of the drawings. To take this measurement the spread assembly is height adjusted and set to the proper spread position such that the arm projections 32 seat against the outside of the upper arm of the individual being measured.

Figure 13:
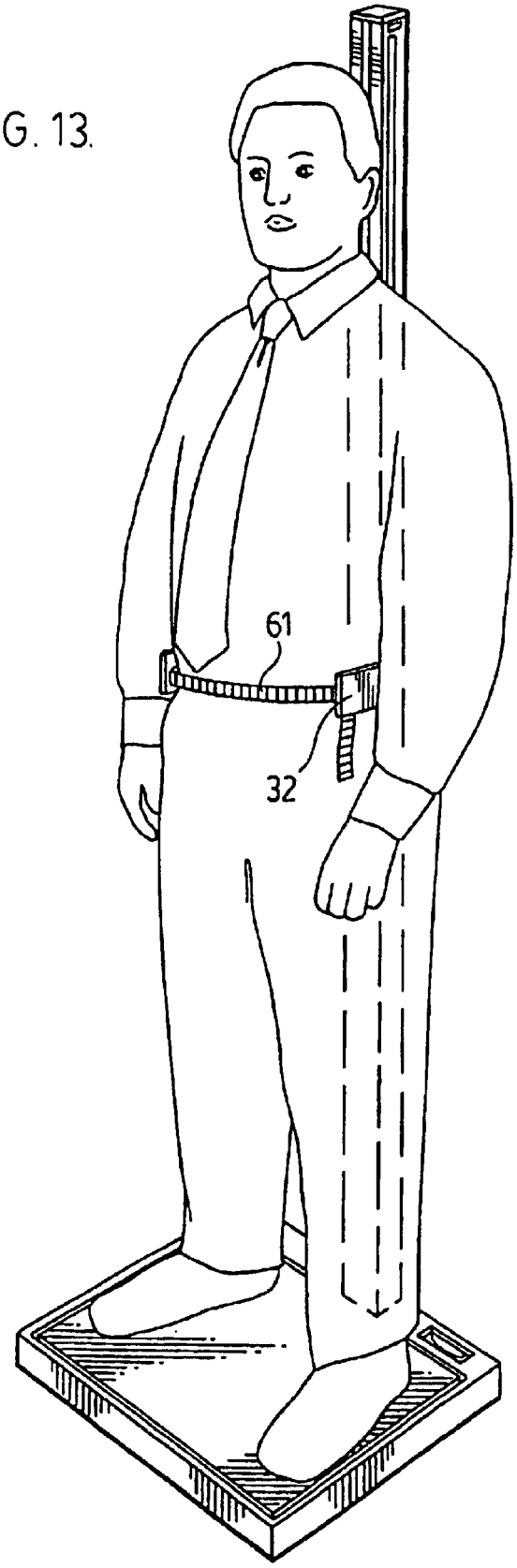

FIG. 13 shows how the device is used to take a waist measurement. To take this particular measurement the height of the spread assembly is adjusted on body portion 3 and the arms are spread such that the projections 32 located at the waist i.e., at the belt level of the person being measured. The tape is then pulled tight while it remains level and wraps around the waist of the individual. Once again the person taking the measurement only has to manipulate the tape at the front of the individual with the manipulation or the control of the tape at the back of the individual being provided by the arm projections 32.

With the device remaining in the FIG. 13 setup another measurement namely the pant length outseam measurement is easily taken. This measurement is determined according to the height setting of the arm projections 32 which are easily read off of body portion 3. In addition, if necessary the retractable tape 65 can be used to measure the length of the pant from the waist to the bottom of the pant along the outside of the leg in the FIG. 13 position of the device.

Figure 14:
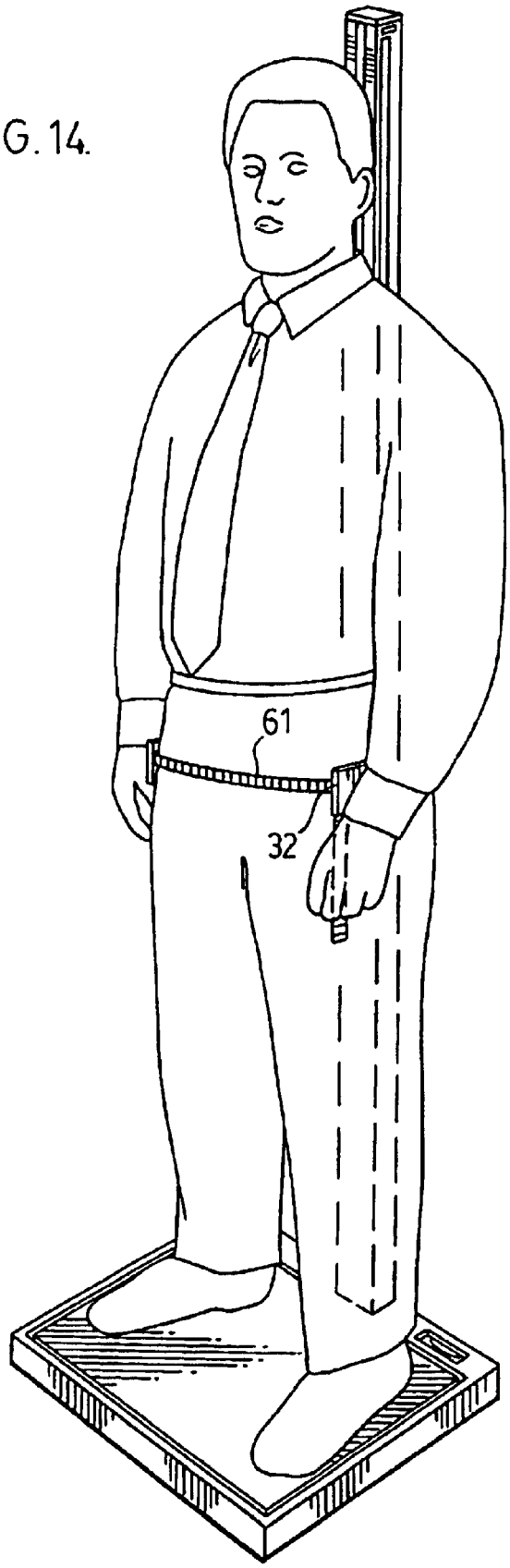

FIG. 14 shows another measurement taken with the device namely the seat measurement for the individual. In order to take this measurement the spread assembly is adjusted such that the forward projections 32 of the spread arms locate to the outside of the legs of the individual at the largest part of the seat of the individual. Tape 61 is again used to take this measurement with the tape only needing to be manipulated at the front of the individual because of the control provided to the rear of the individual by slide mounting of the tape to the arm projections.

Figure 15:
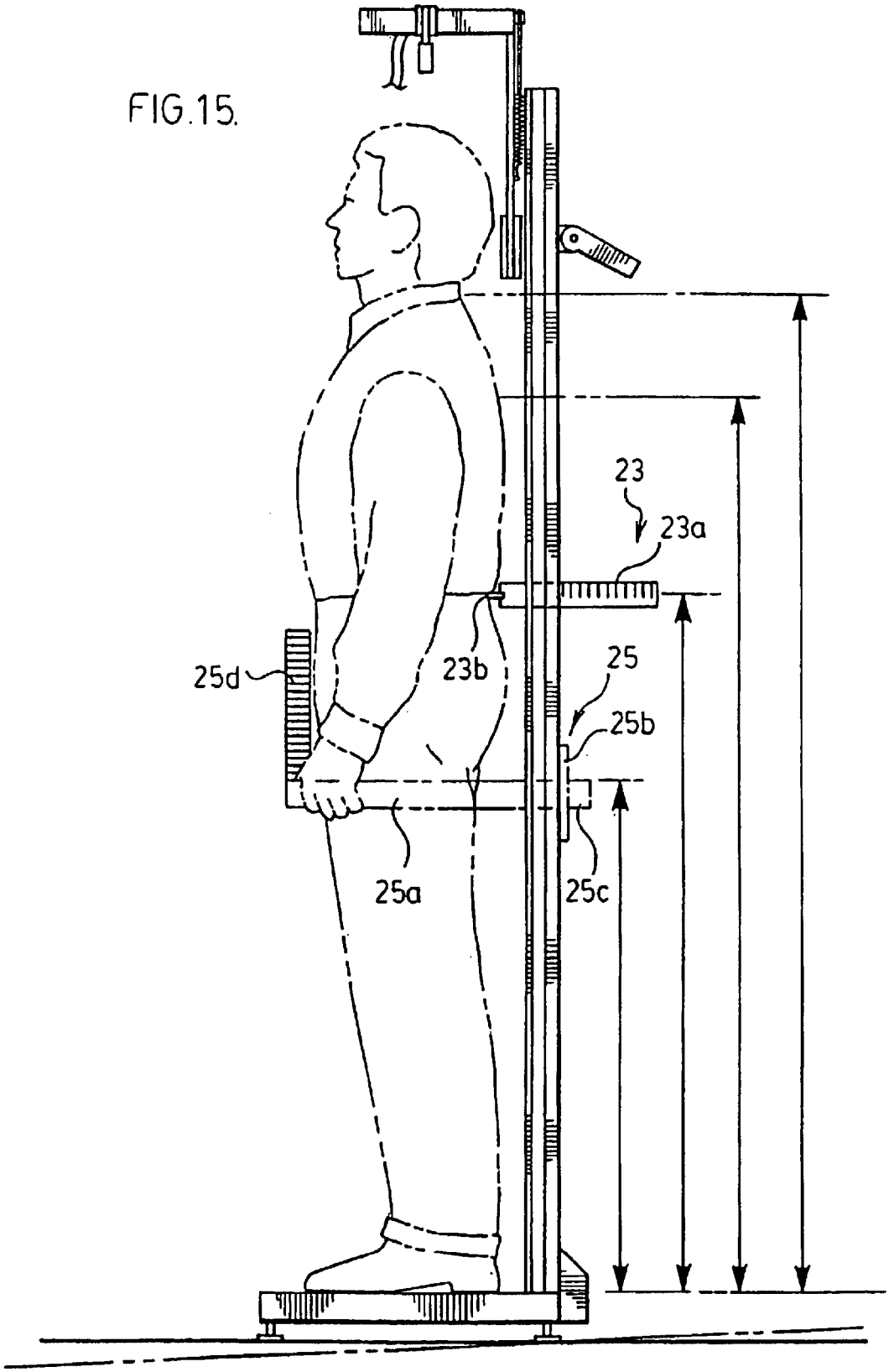

Further measurements which can be taken off the device are the inseam pant rise and indent measurements as shown in FIG. 15 of the drawings. The inseam measurement is taken by pushing the forward arm part 25*a* of tool 25 through slot 19 until the block 25*b* of the tool rests flat against the backside of body portion. The tool is then raised to a point where it is at the upper region of the inner leg of the individual and the height of the tool is then recorded off of either one of the tapes or scales on the upright body portion. As earlier described the flat fitting of the block part 25*b* of the tool with the back surface of the body portion 3 ensures that the arm 25*a* extends perpendicularly from the body portion to ensure the accuracy of this measurement.

From here the foldable arm portion 25*d* can be unfolded to the upwardly extending position of FIG. 15 to provide an accurate pant rise measurement.

As can be seen in FIG. 15 of the drawings the individual shown in this particular figure when standing vertically has different distances of separation from column 3 at different heights along the back of the individual. These are known in the industry as indents. Tool 23 and in particular the scale on the arm part 23*a* of this tool is used to determine these distances at the different elevations along the back of the individual.

FIGS. 1 and 9 of the drawings show another feature of the invention in which a shoulder measuring chart 101 is filled to the upright body portion. This chart which is easily removed and stored elsewhere, when rolled down to the FIG. 9 position, indicates shoulder level for each of the shoulders. The level can be a normal level, a high level which is above normal or a low level below normal.

As an added feature a separate neck measuring device is additionally provided with the system.

As noted above any of the measurements when taken can be recorded manually or the system can easily include automatic measurement taking and recording means. By way of example only, the height adjustment of the spread member can be associated with different types of counters, whether they be mechanical or even electrical which will automatically record the height of the mount of the spread assembly on the upright body portion. The information from these counters can then automatically go into a computerized control system to contain and output the data as desired.

As another preferred feature of the present invention the components of the system are both lightweight and sturdy. This allows the main part, i.e., the upright body portion and attached base to be moved within a clothing store or other similar locations. In addition, the structure can also have a light weight knock down construction which allows it to be moved from site to site by a "traveling" tailor. This has particular application for tailors who provide the personalized services of fitting their customers at the customers location.

Figure 16:
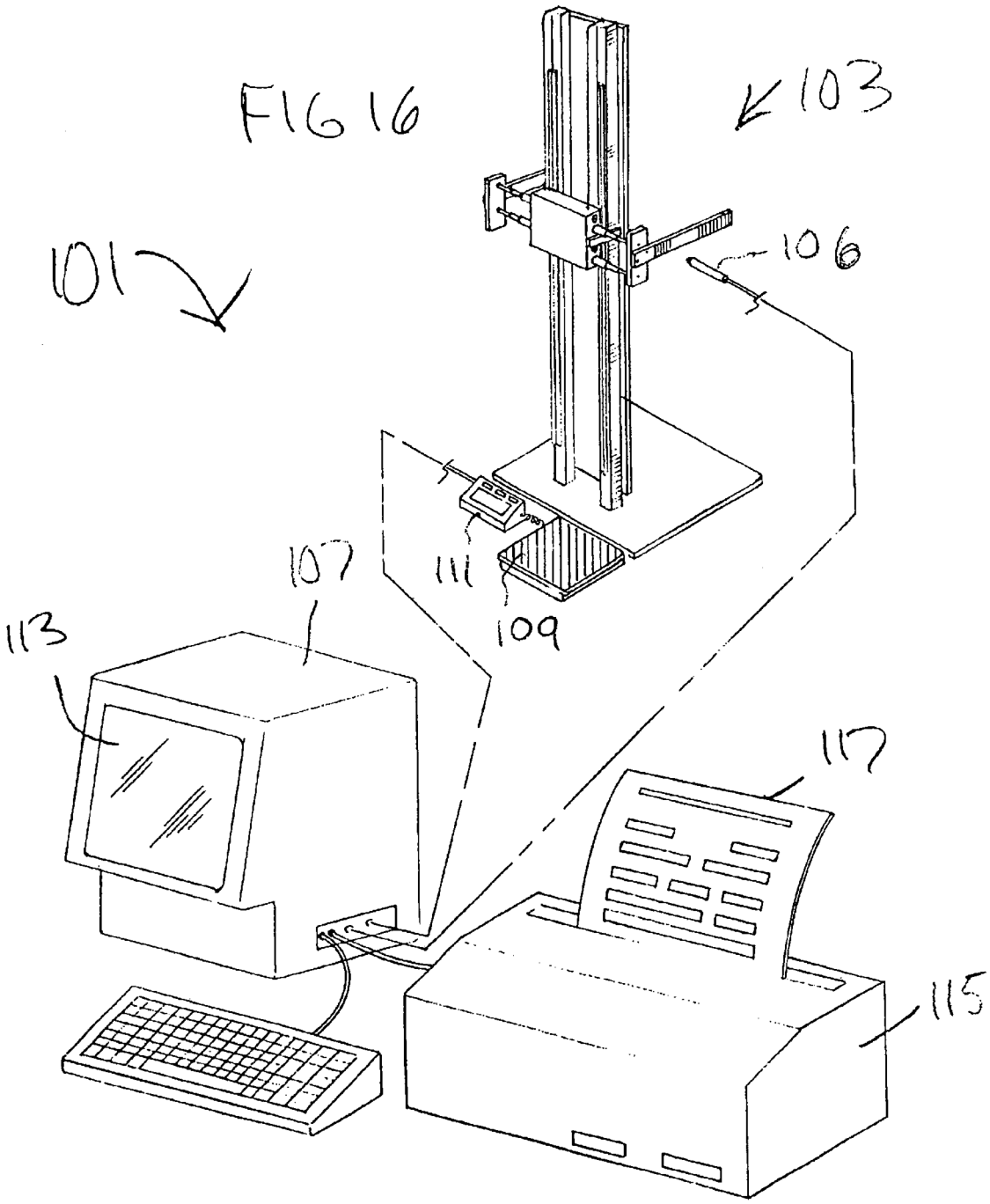
FIG. 16 is a perspective view of an electronically readable tailoring system according to another aspect of the present invention.
Figure 17:
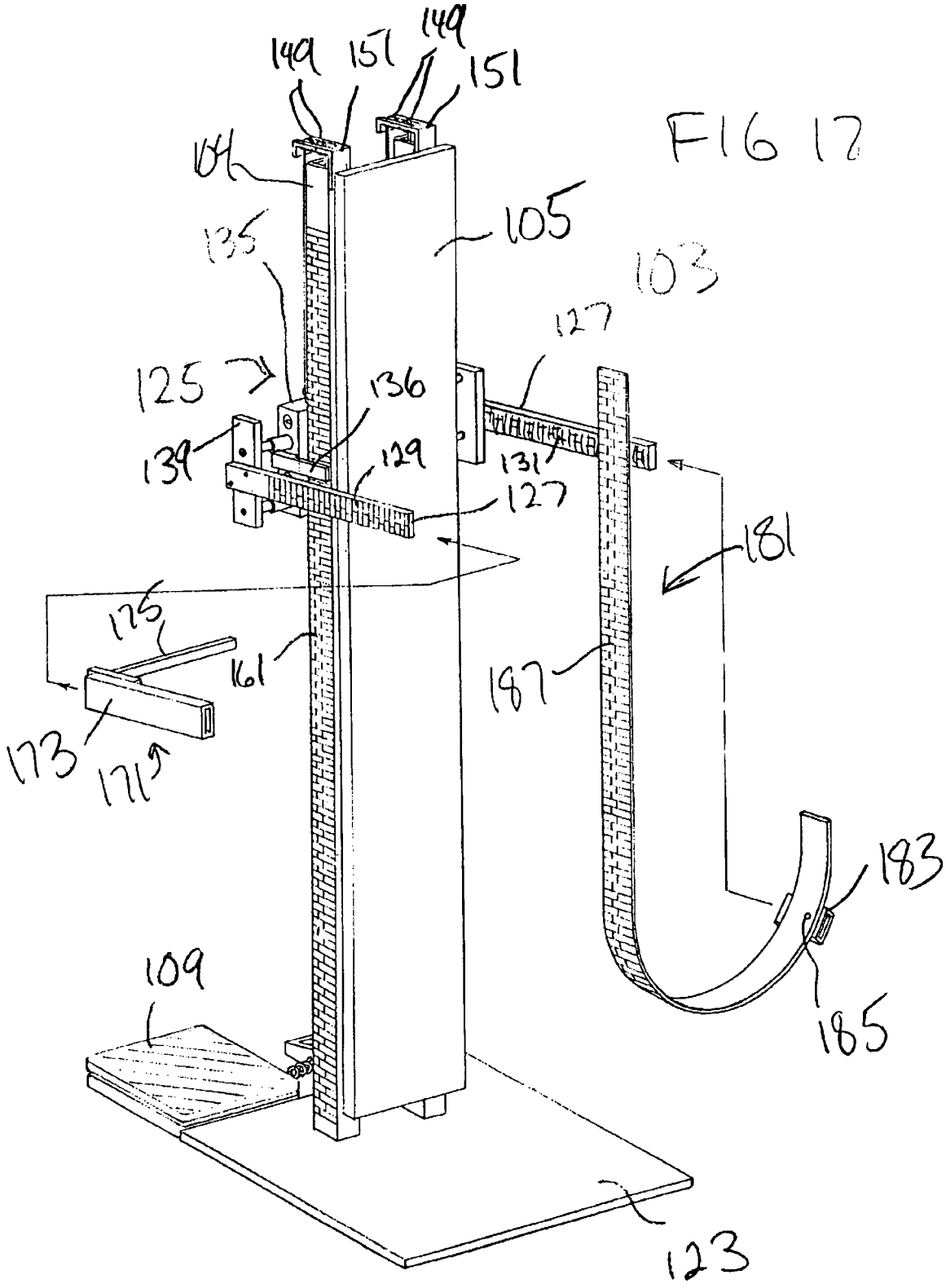
FIG. 17 is a front perspective view of the upright body portion and related measuring tools of the system of FIG. 16.
Figure 18:
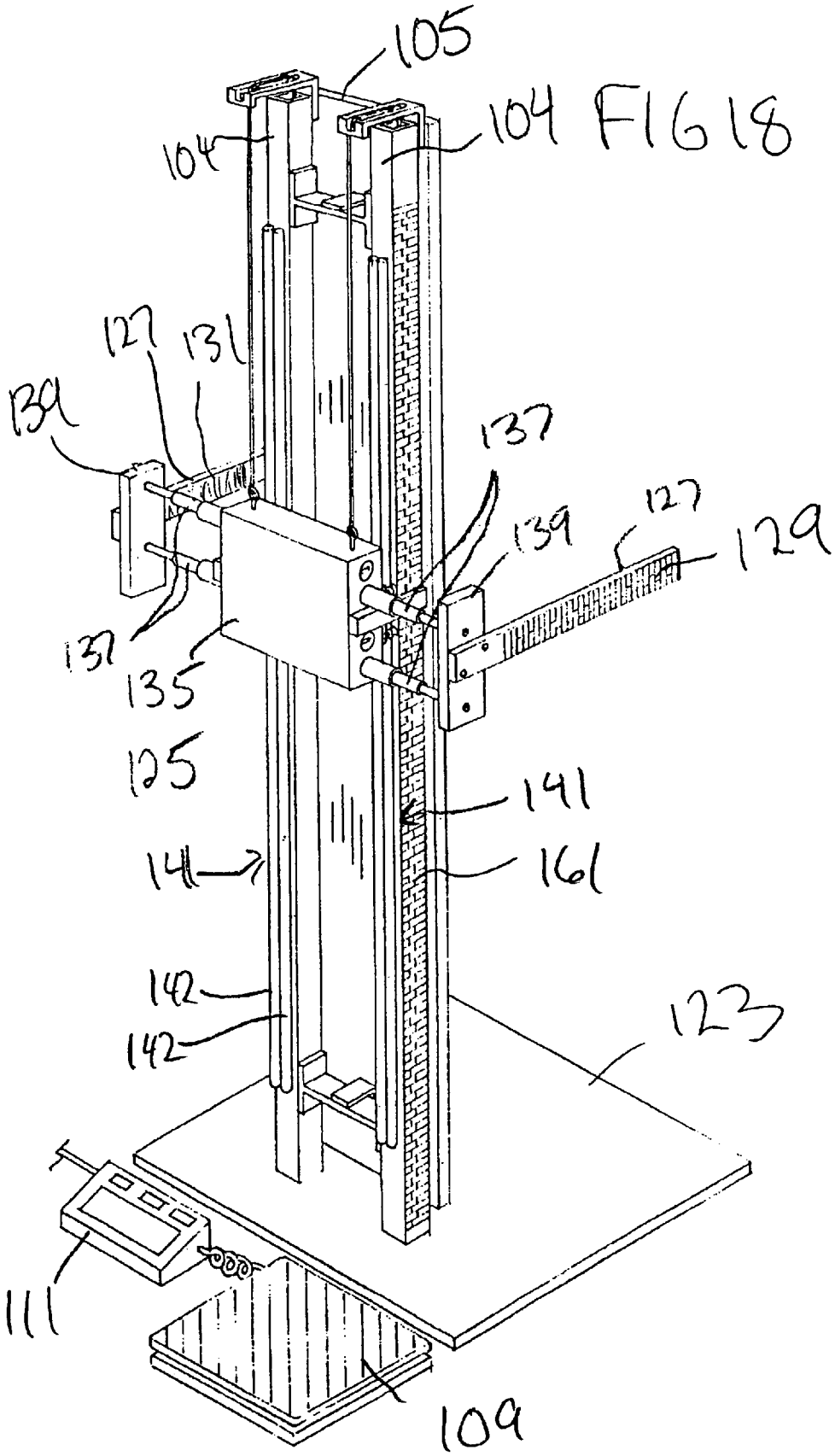
FIG. 18 is a rear perspective view of the upright body portion shown in FIG. 17.

In the embodiments thus far described, the measurements are done visually and recorded by hand. FIG. 16 of the drawing shows a further preferred embodiment of the present invention in the form of a tailoring system with an electronically readable and recordable measurements.

More particularly, FIG. 16 of the drawing shows a tailoring system generally indicated at 101. This system is built around a main upright body portion 103 having different regions of machine readable codes on the body portion. In the preferred embodiment, these codes are in the form of bar codes and a bar code reader 106 is provided for taking the different measurements. These measurements are read by the bar code reader and electronically transferred to a data storage member 107. This data storage member has both a visual display 113 and a printing device 115 that provides a physical print out 117 of the measurements taken using system 101.

The system further includes a weight scale 109 having a visual read -out 111 beside the scale at the main body portion 103. The weight information taken by scale 109 is also electronically communicated to data storage member 107.

System 101, to be described in detail below, incorporates additional benefits provided by an extremely accurate machine reading of different body measurements which are automatically recorded by the machine reader for later use in building a custom fitted garment.

Upright body portion 103 comprises a pair of spaced apart upright members 104. These upright members extend upwardly from and are supported by a base member 123.

Provided to the front side of upright members 104 is a face cover plate 105.

Provided to the rear edges of each of the upright members 104 is a vertical guide 141. Each of the vertical guides comprises a pair of side by side rounded rods 142. These rods can be well seen having reference to FIGS. 19 and 20 of the drawings.

Provided to the rear of members 104 is a height adjustable support member 135. Projecting forwardly from support member 135 are a pair of horizontally extending arms 127.

Arms 127 are mounted by plates 139 to telescopic arms 137. These telescopic arms extend outwardly from opposite sides of support member 135.

Height adjustable support member 135 with its width adjustable arms 127 provides the adjustable spread assembly of system 101.

Also provided to opposite sides of adjustable support member 135 are a pair of shorter arms 136. These arms are located immediately adjacent to the outside edges of members 104. They adjust up and down along the length of the upright members with height adjustment of support member 135.

Support member 135 is fitted with concave faced rollers 143. The concave faces of these rollers locate to opposite sides of each of the guide rods 141. More specifically, they are contoured to the rounded shape of each of the rods 142 in the vertical guides 141. This traps support member 135 on the upright members 104 while allowing up and down adjustment of the support member relative to the upright members.

Figure 19:
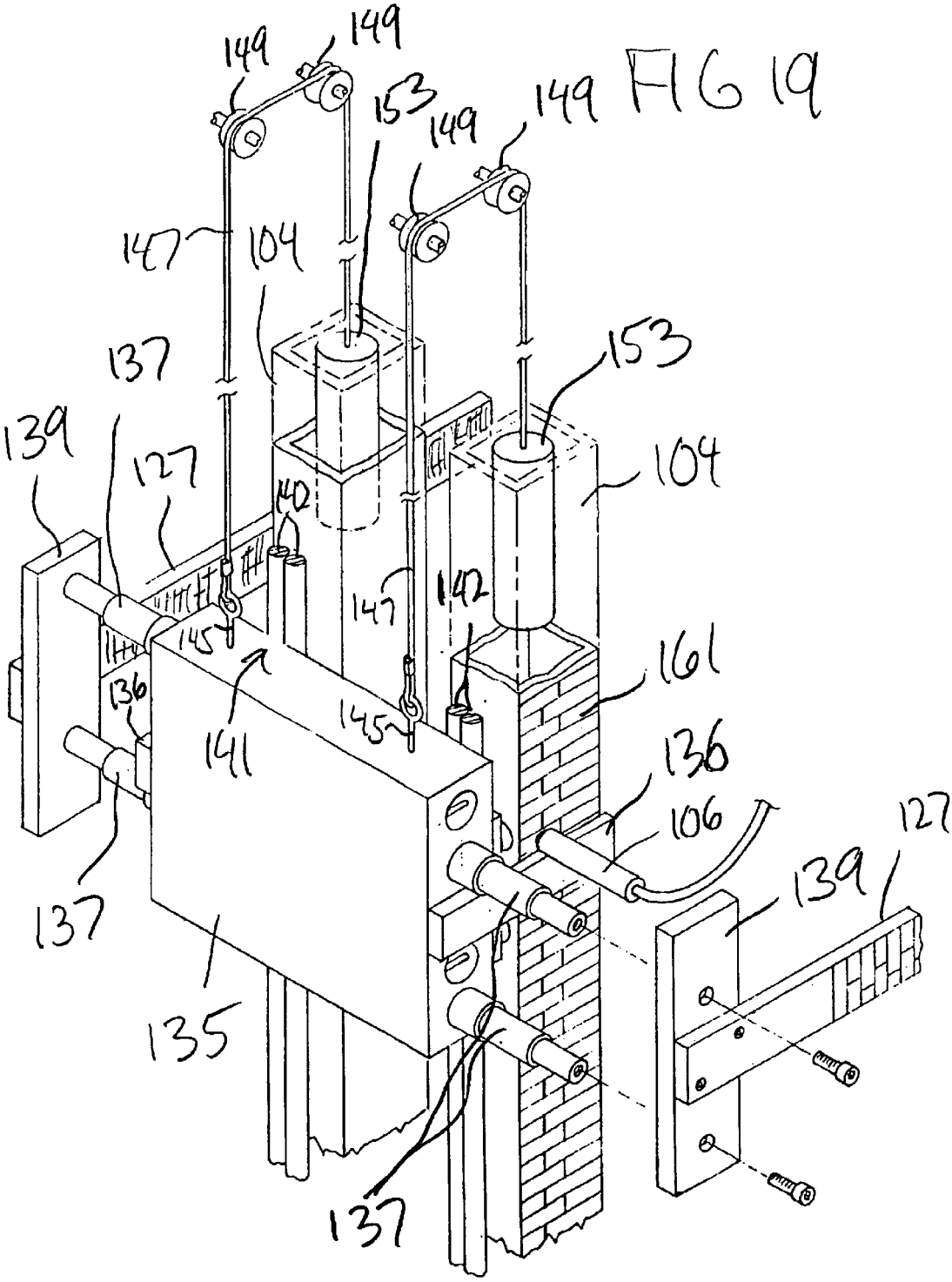
FIG. 19 is a partially exploded rear perspective view of the upper region of the upright body portion shown in FIGS. 17 and 18.

Provided on the upper edge of support member 135 are a pair of eyelet bolts 145. Connected to these eyelet bolts are cables 147. These cables wrap around pulleys 149 secured by brackets 151 at the upper ends of the members 104. These members, as best seen in FIG. 19 of the drawings, are hollow with open top ends. Secured to each of the cables 147 is a counterweight 153 that fits down through the open top end of each of the hollow upright members. Counterweights 153 are weighted to exactly match as much as possible the weight of support member 135 with all of its attachments. With this arrangement, up and down movement of the spread assembly on the two upright members requires nothing more than a relatively light finger touch. The only force that needs to be overcome is the friction and roller resistance which holds support member 135 in any position to which it is height adjusted.

Provided to the outside edge of each of the members 104 is a length of machine readable character and, more specifically, bar code character 161. Bar code character is also provided on each of the arms 127. This bar code character is indicated at 131 on the inside surface of each of the arms and at 129 along the outside surface of each of the arms.

The system further includes a slide tool 171 and a flexible tape measure 181. Slide tool 171 includes a bracket 173 with a central slot running through bracket 173. This slot is dimensioned to slideably fit bracket 173 on to either one of the arms 127.

Extending at generally right angles from bracket 173 is an arm 175.

Tape 181 includes a slotted bracket 183. This slotted bracket is pivotally attached at 185 to the tape. Provided lengthwise of the flexible tape is machine readable bar coding 187.

Consistent with component or tool 171, the bracket 183 of tape 181 is slidably mountable to either one of the arms 127.

System 101, like the earlier described embodiment, is capable of taking a whole host of body measurements including, but not limited to, overall height measurement, shoulder height measurement, shoulder level measurement, inseam and outseam height measurements, in sleeve and out sleeve measurements, underarm and overarm measurements, chest, waist, and seat measurements, indent measurements etc. etc. These different measurements are achieved by moving the various different measuring tools to the appropriate location on upright body portion 103. Once the tools are in their measurement taking positions, the hand held bar code scanner 106 is used to automatically read and record the appropriate measurements.

Some specific examples of how measurements are taken are shown in FIGS. 20, 21, 24 and 26 of the drawings. FIG. 25 shows how the bar code is set up allowing the taking of the accurate measurements.

Reference is first had to FIG. 25 of the drawings. This figure shows the bar coding 161 provided along the side edge of member 104. In the example shown, the bar coding starts at a base or reference level zero and proceeds to a maximum length of 84 inches. Obviously, the bar coding could terminate at any length. However, 84 inches is sufficient to measure a person up to 7 feet in height.

The way the bar code reader works is extremely simple and efficient while at the same time being very novel with the respect to the recording of length measurements. The hand held reader 106 is positioned on the bar code scale over the tool that is used to locate a certain part of the body relative to the scale. The bar code reader is then simply swiped over the bar code reading at that location with the actual bar code character indicating its spacing or distance away from the zero reference level. Again, by way of example, only if the tool were located at 78 inches the hand held bar code reader would be swiped across that location and the coding at that location would indicate that the location is 78 inches from zero, i.e. a reading of 78 inches.

As earlier described, moveable support member 135 includes a pair of relatively short arms 136 secured to opposite sides of the support member. These arms sit directly over the bar code scale 161 on the members 104. Support member 135 is adjustable up and down on members 104. This adjustability is used to measure any one of the different height measurements described above. In recording that height measurement, reader 106 is simply run along the edge of arm 136 as shown in FIG. 26 of the drawings. Arm 136 provides a guide to place the hand held reader over the appropriate machine readable characters to indicate the height of the measurement relative to the zero location on the scale. Zero location is provided level with base 123 on which the person stands while the measurements are being taken.

It should be noted in FIG. 26 that the reading could be taken along either the top or the bottom edge of arm 136 depending upon which particular measurement is being taken.

The actual positioning of each of the arms 136 for most measurements is dictated by the positioning of arms 127 on moveable support 135. To achieve this the arms 127 are level with the arms 136.

By way of example only, for taking a shoulder height measurement, a person will stand on base 123. Adjustable support 135 is height adjusted until the arms 127 and more specifically the bottom edge of arms 127 seat atop the shoulders of the individual being measured. Note that arms 127 are also adjustable inwardly and outwardly of the members 104 to accommodate different shoulder widths.

When the arms 127 are properly seated atop the shoulders, the hand held reader will be run across the bottom edge of arm 136 over the bar code scale 161. The reason for using the bottom edge in this instance is that, as noted above, it is the bottom edges of arms 127 which are seated atop the person's shoulders and which therefore are at the height of the shoulders.

In another measurement as, for example, the taking of an inseam measurement, the person will once again stand on base 123. The base itself is sufficiently large to allow the person to stand off center of body portion 103 such that either one of the arms 127 can be pulled up between the legs of the person being measured. The support is elevated until the arm 127 makes contact with the person. In this case, it is the top edge of arm 127 which determines the inseam measurement to be taken. The hand held reader 106 is therefore run along the upper edge of arm 136 over scale 161 to provide the accurate measurement.

As earlier noted, each of the arms 127 is in turn provided with its own bar code scale. As also earlier described, the scale is applied at 129 to the outside surface of each arm and at 131 to the inside surface of each arm. The inside surface scale 131 is simply a continuation of the outside scale 129.

Again, by way of example only, the scale information 129 which will start at zero from the inner end of the arm may continue to a length of for example 12 inches along the outside surface of the arm. The scale information 131 then starts at the 12 inches and will continue to a maximum length of, for example, 24 inches. The reason for this continued length of scale from the outer to the inner surface of each of the arms 127 is to enable different body part measurements as will be described having reference to FIGS. 21 and 24 of the drawings.

Figure 21:
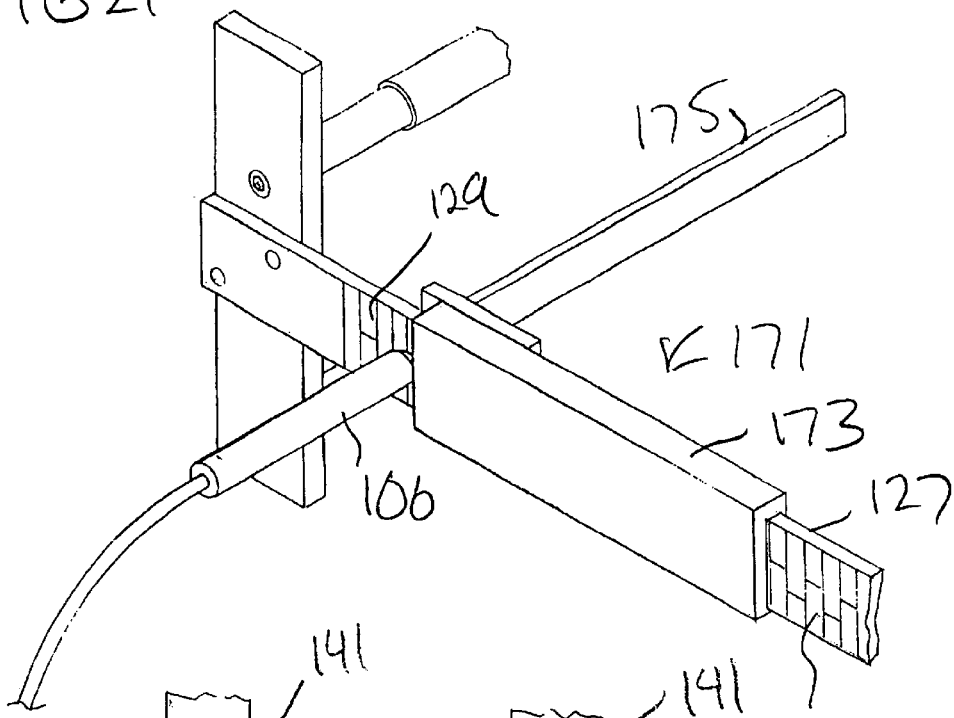
FIG. 21 is a perspective view of one of the measurement tools in position on the upright body portion of FIG. 17.
Figure 22:
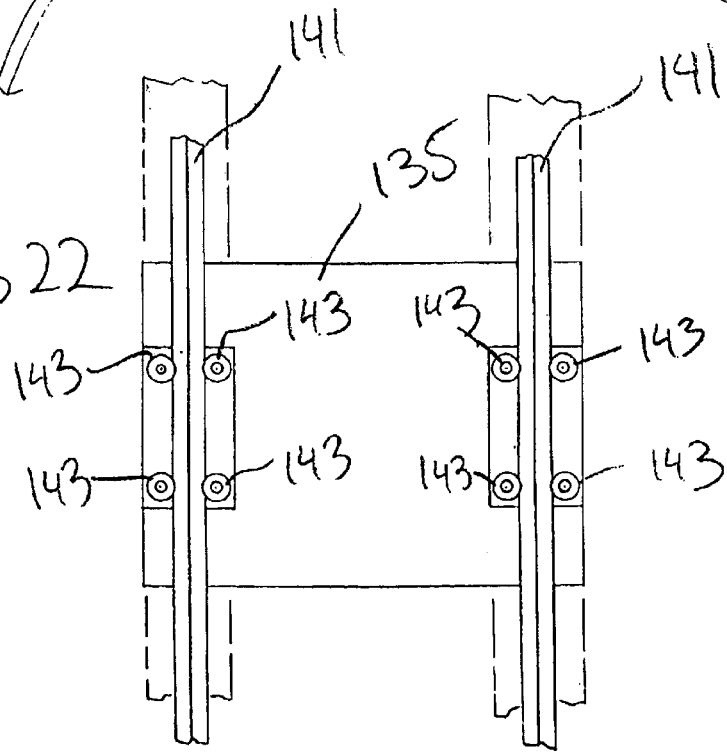
FIG. 22 shows in section the mounting of the arm support member to the main upright body portion of FIG. 17.

FIG. 21 shows the use of tool 171 in taking, for example, an indent measurement. In this case, the front face 105 between the upright members 104 will be at the zero location on the bar scales 129 to the outside surfaces of arms 127. The bracket 173 slideably mounted on arm 127 is pulled forwardly such that bar 175 locates against the back of the person being measured. This, in turn, locates the end of bracket 173 to which arm 175 is attached forwardly away from the zero location on scale 129. The hand held reader is then simply swiped vertically across scale 129 using the end of bracket 173 at the swiping guide. This provides a measurement as to how far the person's back at that location is located forwardly of the zero position on the scale.

As is to be understood, when taking something like a normal indent measurement, bar 175 will never reach a position to necessitate a repositioning of bracket 173 on arm 127 from what is shown in FIG. 21 of the drawings. However, the same cannot be said for taking, for example, a chest depth measurement which could well necessitate reversing of the tool 171 to the FIG. 24 position. In this position, the arm 175 will locate against the front surface of the chest of a person standing on base 123. Furthermore, the depth of the chest may be such that the end of the bracket 173 supporting arm 175 is located outwardly beyond the end of arm 127. In this scenario, the measurement is taken from scale 131 to the inside of arm 127 at the opposite end of bracket 173 as shown in FIG. 24. The measurement being taken is again based on the zero location of the scale which takes into consideration the full length of the scale information 129 along the outside surface of arm 127 as well as the additional length of scale information 131 to the inside of the arm 127.

Again by way of example only, in the FIG. 24 position the end of bracket 173 which is being used to take the measurement might be 9 inches away from the front face 105 of the upright body portion. However, because the length of arm 127 is 12 inches (consistent with the example given above) the chest depth measurement will actually read as 15 inches. This measurement is arrived at as a result of the measurement taking into consideration the full 12 inches along the outside surface of arm 127 as well as the additional 3 inches measured to the inside surface of arm 127 which places the end of the bracket 9 inches off of the face plate.

Figure 20:
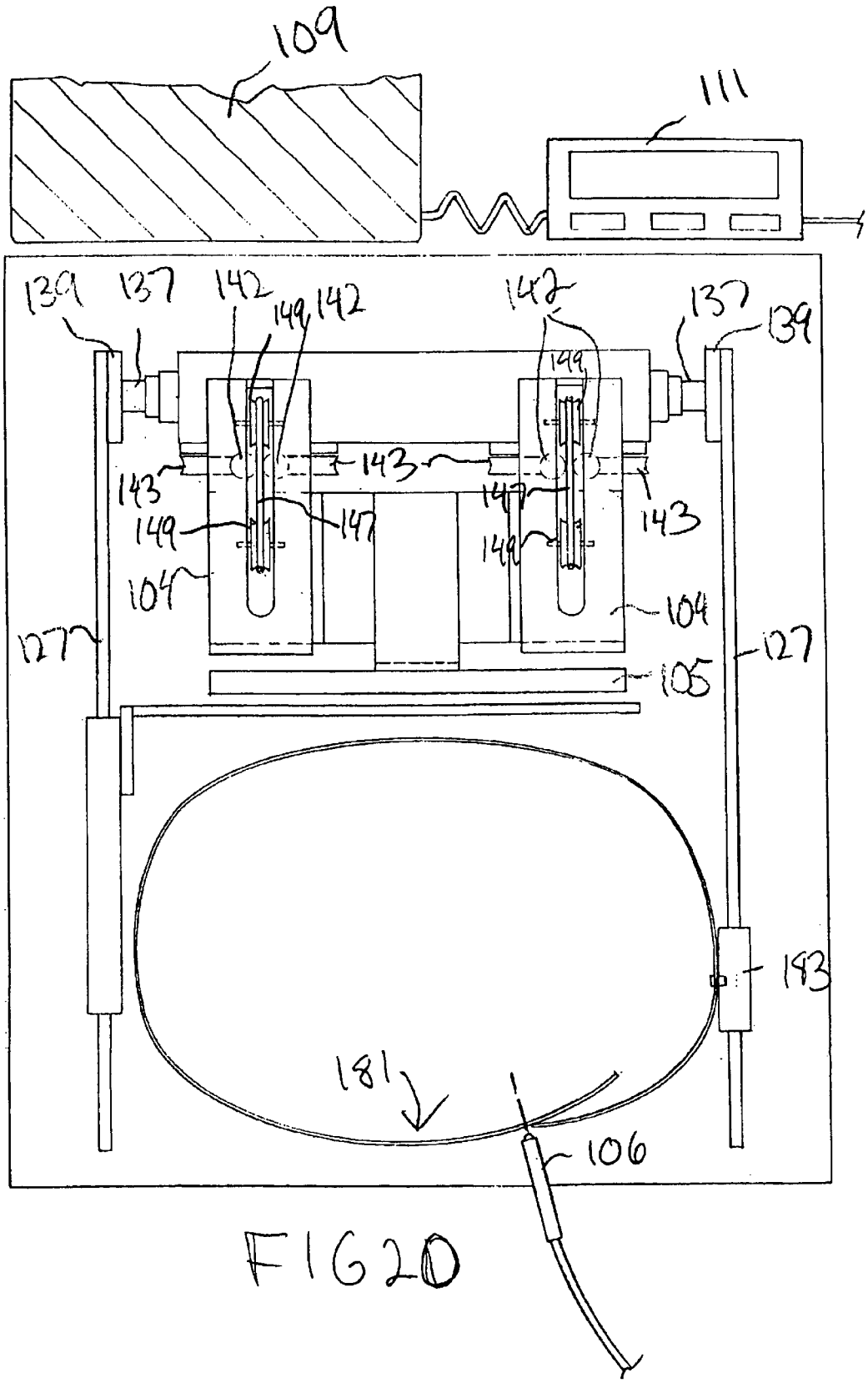
FIG. 20 is a plan view looking down on the upright body portion of FIG. 17 with the related tools in their various different operating positions.

Another tool used in the system of FIG. 16 is the flexible measuring tape 181. This tape, like the other tools, has a bar code scale starting from a zero reference level and extending to a length of, for example, 60 inches or more. Although useable for essentially any type of measurement, the preferred use for tape 181 is in the taking of different types of girth measurements. The positioning of the tape for taking a girth measurement is best shown in FIG. 20 of the drawings. Here it will be seen that the bracket 183 slides on to arm 127 which is adjusted either inwardly or outwardly to fit against the side of the person at the location of the body that is being measured. To this end support 135 is also height adjusted for the appropriate location, eg. to be level with the chest, waist, seat, thighs etc. The tape is then drawn around the person at that location and the hand held reader is run across the tape where the measurement is being taken as shown in FIG. 20 of the drawings. The distance from zero on the tape is then machine read and automatically recorded in data storage member 107 as is the case with all of the measurements that are taken in any of the examples given above.

As is to be now understood in reference to FIGS. 16 through 26 of the drawings, extremely accurate and automatically recorded measurements are easily and quickly taken using system 101. Furthermore, for customer profile purposes, this information is automatically recorded and stored in data storage member 107. The information is easily retrieved by either displaying it at the visual display 113 or by the information outputting from the data storage member as a print out 117.

Data storage member 107 can also provide electronic transmission of the information to a separate remote location. This is extremely helpful in a case where the garment is made at a location different from the location where the measurements are taken.

According to another aspect of the present invention, an associated software package is provided with the system. This software package can have a number of different features. It can easily explain to the individual using the device how the different measurements can be taken. In another application which is particularly interesting the software package can adapt the measurements taken by the device for various different garment manufacturers. This is particularly important in that different garment manufacturers have different cutting styles and patterns for their suits and jackets. Therefore even though two garment manufacturers may receive the same measurements the actual shape of the garment will differ from one manufacturer to another. The software package of the present invention takes this into consideration and is coded such that the measurements taken off the device are adapted to ensure that a garment made by any one of a number of different garment manufacturers will fit the individual who has been measured from the device.

Although various preferred embodiments of the present invention have been described in detail, it will be appreciated by those skilled in the art that variations may be made without departing from the spirit of the invention.

The embodiments of the invention in which an exclusive property or privilege is claimed are defined as follows:

1. A tailoring guide system used in taking body measurements for garment fitting in accordance with accented tailoring measurements, said guide system comprising an upright portion of a height at least as great as that of an individual of average height, and a spread assembly which is adjustable in height relative to said upright portion, said upright portion including electronic measuring means to determine and record different heights to which said spread assembly is adjusted, said spread assembly being freely movable on said upright portion for determining shoulder, chest, waist and seat measurements of an individual standing on said system, said spread assembly comprising a pair of arms, one to each side of said upright portion, said arms being adjustable inwardly and outwardly to different spread positions relative to said upright portion and electronic measuring means to determine and record positioning of said arms in said different spread positions, said pair of arms further including a measuring tape supported by and movable with said arms for providing, girth body measurements including shoulder, chest, waist and seat measurements, said measuring tape including thereon a standard measurement scale and an electronically readable scale corresponding to said standard measurement scale, said guide system further including a portable reader for reading of said electronically readable scale and a database for recording of said different heights, positioning of said pair of arms and said girth body measurements of an individual.

2. A guide system as claimed in claim 1, wherein said spread assembly has a center part which is adjustably mounted to said upright portion, said arms extending outwardly to opposite sides of said center part of said spread assembly.

3. A guide system as claimed in claim 2 wherein said center part comprises a bracket and wherein arms are connected to one another at said bracket by an arm connector which produces simultaneous uniform movement of both of said arms.

4. A guide system as claimed in claim 1 wherein said upright portion is supported by a base platform on which an individual stands for the taking of the body measurements, said system including an indicator to show exact upright positioning of said spread assembly and means to adjust said system to provide said exact upright positioning.

5. A guide system as claimed in claim 1 including a weight scale.

6. A guide system as claimed in claim 1 wherein said system includes a computer arrangement that adjusts the measurements associated with an individual to different garment manufacturers specifications.

7. A guide system as claimed in claim 1 wherein said spread assembly comprises a support member which is slideably attached to said upright portion, said system including counter balancing means which substantially offsets weight of said spread assembly on said upright portion.

8. A guide system as claimed in claim 7 wherein said upright portion has an upper end which opens to a hollow region in said upright portion, said counter balancing means comprising a counter balancing weight secured by a cable around a pulley to said support member, said counter balancing weight being fitted through said upper end into said hollow region of said upright portion.

9. A guide system as claimed in claim 1 wherein said spread assembly comprises a support member slideably mounted to said upright portion, a pair of first arms which are width adjustably mounted to said support member and a pair of second arms secured to said support member and extending directly over opposite side edges of said upright portion, said upright portion being provided with measurement scales along said side edges thereof.

10. A guide system as claimed in claim 9 wherein said measurement scales comprise bar coding of machine readable characters and said portable reader is a hand held barcode reader, said second arms providing guides for guiding movement of said barcode reader over the characters of said bar coding.

11. A guide system as claimed in claim 10 wherein said first arms are provided with bar coding extending lengthwise thereof, said system including portable tools which mount on and slide to different positions along said first arms, the different positions being measured using the bar coding extending along the first arms.

12. A tailoring guide system comprising a structure including an upright portion sildably supporting a pair of arms generally throughout said upright portion with one arm either side of said upright portion and one of said arms having attached thereto a flexible electronically readable measuring tape for taking different body measurements of a person at said structure to define paired height and girth body measurements, electronically readable measurement means on said paired arms and an electronic reader which reads positioning of said paired arms relative to said upright portion using said electronically readable measurement means to provide the different height body measurements and said electronically readable flexible tape and said electronic reader being used to provide said girth body measurement at the height of said positioned arms to define said paired height girth body measurements.

13. A tailoring guide system as claimed in claim 12 wherein said electronically readable measurement means comprises a plurality of bar coded regions on said upright portion, said electronic reader comprising a bar code reader.

14. A tailoring guide system as claimed in claim 13 wherein said system includes a data storage electronically connected to said bar code reader which reads and transfers the different body measurements to said data storage.

15. A tailoring guide system as claimed in claim 14 wherein said data storage has both a display and a printout mode for outputting the different body measurements from the data storage.

16. A tailoring guide system as claimed in claim 12 wherein at least one of paid pair of arms is provided with bar coding which extends lengthwise of the arm and which is used for taking body depth related measurements from said system.

17. A tailoring guide system as claimed in claim 12 said electronically readable flexible tape includes bar coding provided lengthwise of said tape, said tape including a bracket which mounts said tape to one of the arms of said arm support member.

* * * * *